US008899710B2

(12) United States Patent
Shinkawa et al.

(10) Patent No.: US 8,899,710 B2
(45) Date of Patent: Dec. 2, 2014

(54) PRINTING APPARATUS AND INSPECTION METHOD

(71) Applicant: Seiko Epson Corporation, Tokyo (JP)

(72) Inventors: Osamu Shinkawa, Chino (JP); Kenji Otokita, Nagano (JP); Masahiko Yoshida, Shiojiri (JP); Tsuneo Kasai, Azumino (JP); Toshiyuki Suzuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/851,628

(22) Filed: Mar. 27, 2013

(65) Prior Publication Data

US 2013/0257945 A1 Oct. 3, 2013

(30) Foreign Application Priority Data

Apr. 3, 2012 (JP) ..... 2012-084607
May 1, 2012 (JP) ..... 2012-104696
May 1, 2012 (JP) ..... 2012-104697

(51) Int. Cl.
*B41J 29/393* (2006.01)

(52) U.S. Cl.
USPC ..... 347/9; 347/5; 347/14

(58) Field of Classification Search
USPC ..... 347/5, 9, 14, 19
See application file for complete search history.

(56) References Cited

U.S. PATENT DOCUMENTS

2005/0057598 A1 3/2005 Endo et al.
2010/0066780 A1 3/2010 Akatsuka
2011/0285775 A1* 11/2011 Shinkawa ..... 347/14

FOREIGN PATENT DOCUMENTS

JP 2005-022219 1/2005
JP 2007-030344 2/2007
JP 2010-069637 4/2010
JP 2011-011439 1/2011

* cited by examiner

*Primary Examiner* — Lam S Nguyen
(74) *Attorney, Agent, or Firm* — Workman Nydegger

(57) ABSTRACT

A liquid discharge apparatus which causes a liquid to be discharged through a first nozzle by applying a driving signal to a first driving element, and causes a liquid to be discharged through a second nozzle by applying the driving signal to a second driving element, and which, with respect to the first nozzle, determines on the basis of an image formed by causing the liquid to be discharged through the first nozzle whether or not the first nozzle causes a liquid discharge failure, and, with respect to the second nozzle, determines on the basis of a detection signal which is obtained by applying the driving signal to the second driving element whether or not the second nozzle corresponding to the second driving element causes a liquid discharge failure.

4 Claims, 23 Drawing Sheets

FIG. 18

| | DOT-POSITION SHIFTING BIT | DOT-SIZE BIT |
|---|---|---|
| DOT-POSITION SHIFTING IS NOT NEEDED NO TARGET DOT | 0 | 00 |
| DOT-POSITION SHIFTING IS NOT NEEDED SMALL-SIZE DOT | 0 | 01 |
| DOT-POSITION SHIFTING IS NOT NEEDED MIDDLE-SIZE DOT | 0 | 10 |
| DOT-POSITION SHIFTING IS NOT NEEDED LARGE-SIZE DOT | 0 | 11 |
| DOT-POSITION SHIFTING IS NEEDED SMALL-SIZE DOT | 1 | 01 |
| DOT-POSITION SHIFTING IS NEEDED MIDDLE-SIZE DOT | 1 | 10 |
| DOT-POSITION SHIFTING IS NEEDED LARGE-SIZE DOT | 1 | 11 |

FIG. 20

| | INSPECTION BIT | DOT-SIZE BIT |
|---|---|---|
| INSPECTION IS NOT NEEDED NO TARGET DOT | 0 | 00 |
| INSPECTION IS NOT NEEDED SMALL-SIZE DOT | 0 | 01 |
| INSPECTION IS NOT NEEDED MIDDLE-SIZE DOT | 0 | 10 |
| INSPECTION IS NOT NEEDED LARGE-SIZE DOT | 0 | 11 |
| INSPECTION IS NEEDED NO TARGET DOT | 1 | 00 |
| INSPECTION IS NEEDED SMALL-SIZE DOT | 1 | 01 |
| INSPECTION IS NEEDED MIDDLE-SIZE DOT | 1 | 10 |
| INSPECTION IS NEEDED LARGE-SIZE DOT | 1 | 11 |

PRINTING APPARATUS AND INSPECTION METHOD

BACKGROUND

1. Technical Field

The present invention relates to a printing apparatus and an inspection method.

2. Related Art

Known examples of a printing apparatus include already practically used printers each causing fluids such as inks to be ejected through respective nozzles by driving piezoelectric elements or the like corresponding thereto. For such a printer, various methods each for inspecting a fluid ejection failure have been proposed.

In JP-A-2011-11439, it is described that mutually different driving signals are used for a white ink and a color ink, respectively. In JP-A-2007-30344, it is described that a waveform for discharging and a waveform for detection are provided during one cycle of a driving signal, and the detection is performed during a scanning of a carriage. In JP-A-2005-22219, it is described that, in the case where a detection of the lack of dots for a clear ink is performed by using a clear pattern superimposed on a color pattern, a resolution of the clear pattern is lower than a resolution of the color pattern.

It is possible to detect an ejection failure of a color ink or the like by inspecting an image having been formed as the result of ejections thereof onto a medium. Meanwhile, with respect to an ink which is hard to be optically detected, it is difficult to detect an ejection failure of such an ink by inspecting an image having been formed as the result of ejections thereof onto a medium. Further, under the situation where a medium is continuously fed, it is desirable to perform these two kinds of ejection failure inspections during printing.

SUMMARY

An advantage of some aspects of the invention is to provide a printing apparatus and an inspection method which make it possible to perform two kinds of ejection inspections concurrently during printing, one being for an ink which can be optically detected, the other one being for an ink which is hard to be optically detected.

A printing apparatus according to a main aspect of the invention includes a first ejection unit having a first driving element that causes a first ink to be ejected through a nozzle; a second ejection unit having a second driving element that causes a second ink to be ejected through a nozzle; a first driving signal generation unit that generates a first driving signal to be applied to the first driving element; a second driving signal generation unit that generates a second driving signal to be applied to the second driving element; a control unit that causes an image to be formed by applying the first driving signal to the first driving element to cause the first ink to be ejected, and applying the second driving signal to the second driving element to cause the second ink to be ejected; a first inspection unit that inspects the first ejection unit on the basis of an image which is formed on a medium by using the first ink; and a second inspection unit that detects a vibration occurring in the second ejection unit, and inspects the second ejection unit on the basis of the vibration.

Other features of the invention will be made obvious through description of this patent document and accompanying drawings.

BRIEF DESCRIPTION OF THE DRAWINGS

The invention will be described with reference to the accompanying drawings, wherein like numbers reference like elements.

FIG. 18 is a diagram for describing pixel data for a color ink, according to a first embodiment of the invention.

FIG. 20 is a diagram for describing pixel data for a clear ink, according to a first embodiment of the invention.

DESCRIPTION OF EXEMPLARY EMBODIMENTS

Figure 1:
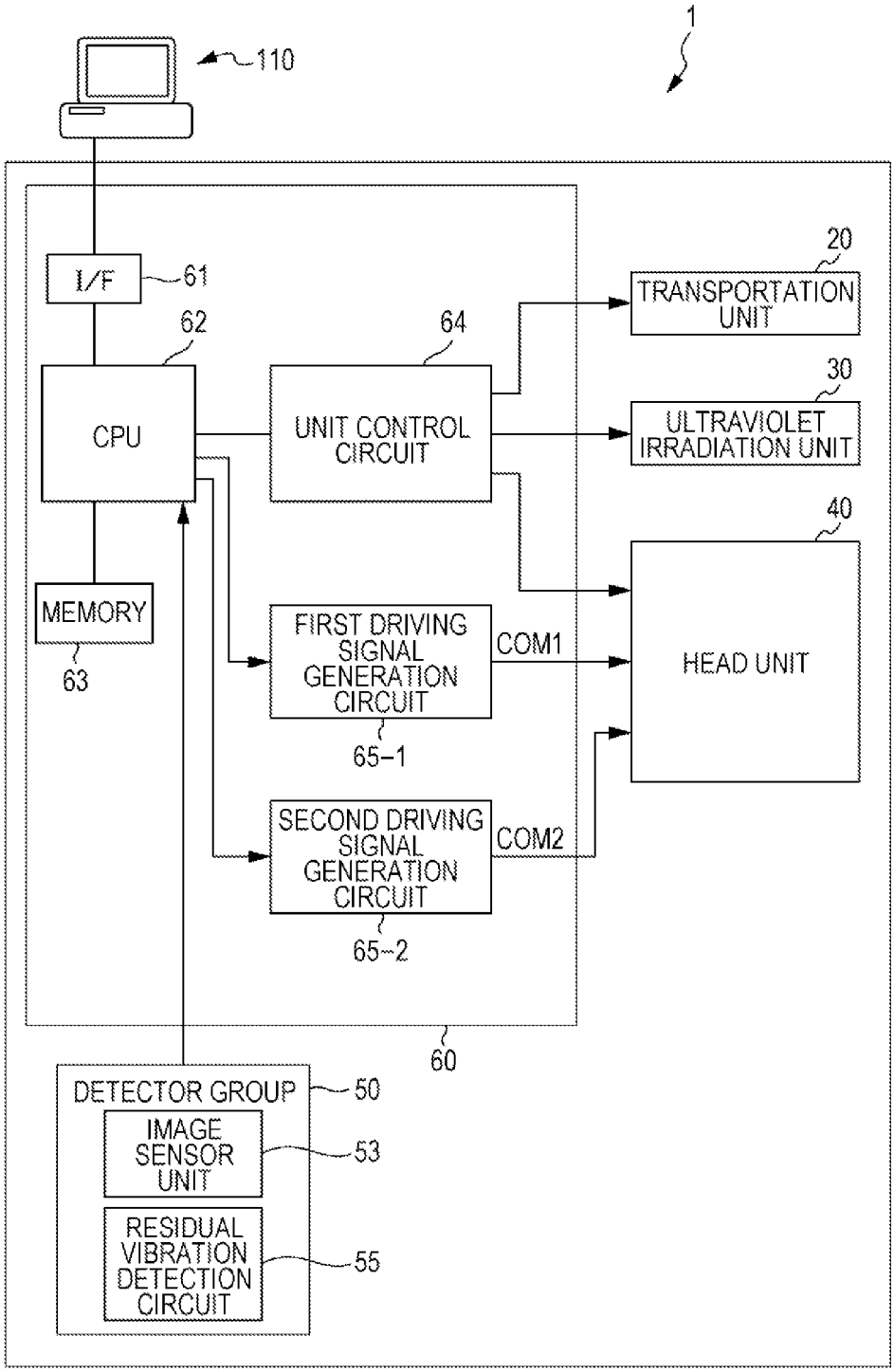
FIG. 1 is a block diagram illustrating the entire configuration of a printer according to a first embodiment of the invention.

Through description of this patent document and the accompanying drawings, at least the following respects will be made obvious. That is, a printing apparatus according to an aspect of the invention includes a first ejection unit having a first driving element that causes a first ink to be ejected through a nozzle; a second ejection unit having a second driving element that causes a second ink to be ejected through a nozzle; a first driving signal generation unit that generates a first driving signal to be applied to the first driving element; a second driving signal generation unit that generates a second driving signal to be applied to the second driving element; a control unit that causes an image to be formed by applying the first driving signal to the first driving element to cause the first ink to be ejected, and applying the second driving signal to the second driving element to cause the second ink to be ejected; a first inspection unit that inspects the first ejection unit on the basis of an image which is formed on a medium by using the first ink; and a second inspection unit that detects a vibration occurring in the second ejection unit, and inspects the second ejection unit on the basis of the vibration.

In this way, with respect to the first ink, such as a color ink, whose color can be detected, a failure of the first ejection unit is inspected on the basis of an image formed on a medium; while, with respect to the second ink, such as a transparent ink, whose color is hard to be detected, a failure of the second ejection unit can be inspected by detecting a vibration occurring in the second ejection unit. Further, it is possible to perform two kinds of ejection inspections concurrently during printing, one being for an ink which can be optically detected, the other one being for an ink which is hard to be optically detected.

In the printing apparatus according to the aspect of the invention, preferably, the first ink is a color ink, and the second ink is a clear ink.

In this way, with respect to the first ink which can be optically detected, it is possible to inspect a failure of the first ejection unit on the basis of an image formed on a medium. Meanwhile, with respect to the second ink which is hard to be optically detected, it is possible to detect a failure of the second ejection unit on the basis of a vibration occurring in the second ejection unit.

Further, preferably, the first ejection unit is located at an upper stream side than the second ejection unit in a direction in which the medium is transported, the first inspection unit includes a sensor for detecting the image, and the sensor is provided between the first ejection unit and the second ejection unit in the direction in which the medium is transported.

In this way, it is possible for the first inspection unit to inspect the first ink having been ejected by the first ejection unit without any influence of the second ink ejected by the second ejection unit.

Further, preferably, when a failure has been detected in at least one of the first inspection unit and the second inspection unit, an ejection from the first ejection unit and an ejection from the second ejection unit are halted.

In this way, it is possible to halt printing at the time when it has become difficult to eject an ink appropriately.

Further, preferably, the first ink and the second ink are ultraviolet hardening type inks, respectively, an irradiation apparatus for hardening the ultraviolet hardening type inks is provided, and an irradiation operation performed by the irradiation apparatus is halted after the completion of the irradiation operation onto an ink having been landed on the medium.

In this way, when a medium having been subjected to printing is wound, it is possible to prevent the medium from sticking to the medium itself because of a not-yet-hardened ink.

Further, alternatively, the first ejection unit is located at an upper stream side than the second ejection unit in a direction in which the medium is transported, the first inspection unit includes a sensor for detecting the image, and the sensor is provided at a lower stream side than the first ejection unit and the second ejection unit in the direction in which the medium is transported.

In this way, in the case where a transparent clear ink is ejected from the second ejection unit, it is possible to detect a failure of the first ejection unit by using the sensor.

Further, preferably, in the case where a failure of the second ejection unit has been detected by the second inspection unit, image data having been read in from the medium by the first inspection unit is corrected, and the first ejection unit is inspected on the basis of the corrected image data.

In this way, since the influence of the second ejection unit can be removed by correcting the image data, it is possible to appropriately perform an inspection for an ejection failure of the first ejection unit.

Further, through this patent document and the accompanying drawings, at least the following respect will be also made obvious. That is, an inspection method according to another aspect of the invention includes generating a first driving signal to be applied to a first driving element that ejects a first ink through a nozzle; generating a second driving signal to be applied to a second driving element that ejects a second ink through a nozzle; forming an image on a medium by applying the first driving signal to the first driving element to cause the first ejection unit to eject the first ink, and further applying the second driving signal to the second driving element to cause the second ejection unit to eject the second ink; inspecting the first ejection unit on the basis of an image which is formed on the medium by the first ink; and detecting a vibration occurring in the second ejection unit and inspecting the second ejection unit on the basis of the vibration.

In this way, with respect to the first ink, such as a color ink, whose color can be detected, a failure of the first ejection unit is inspected on the basis of an image formed on a medium; while, with respect to the second ink, such as a transparent ink, whose color is hard to be detected, a failure of the second ejection unit can be inspected by detecting a vibration occurring in the second ejection unit. Further, it is possible to perform two kinds of ejection inspections concurrently during printing, one being for an ink which can be optically detected, the other one being for an ink which is hard to be optically detected.

First Embodiment

In the following embodiment, an ink jet printer (hereinafter also referred to as a printer 1) is taken as an example of a printing apparatus, and will be described.

Configuration of Printer

Figure 2:
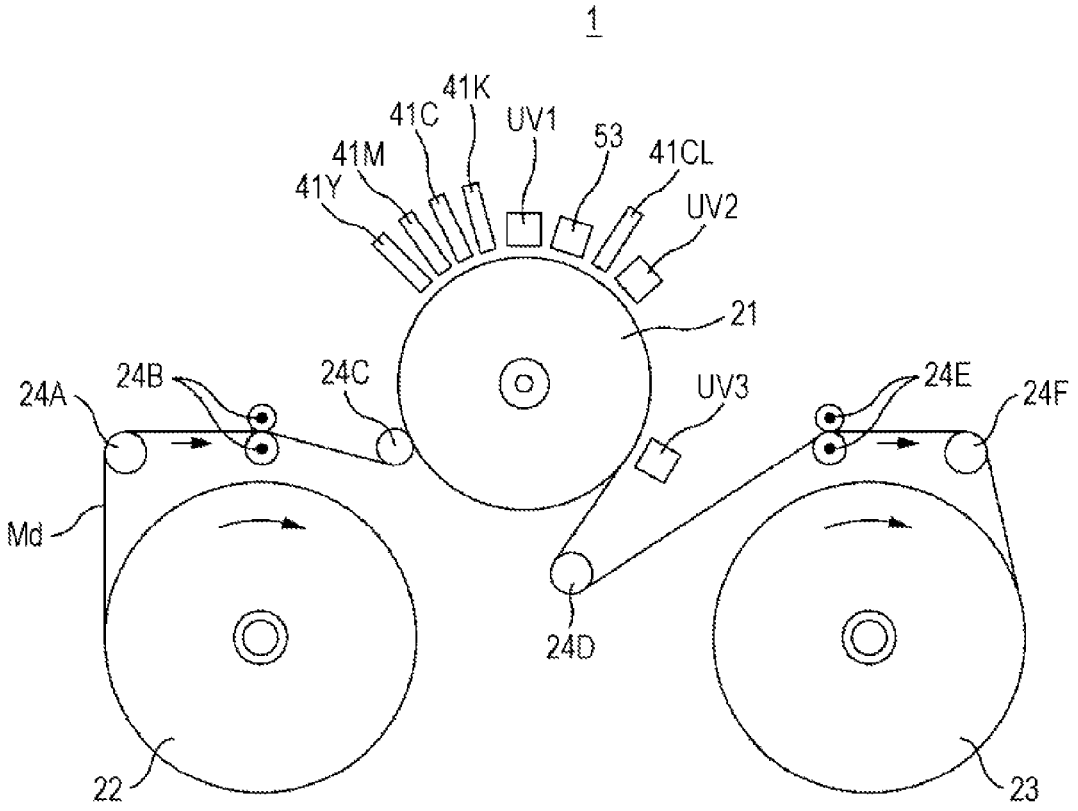
FIG. 2 is a side view of a printer according to a first embodiment of the invention.
Figure 3:
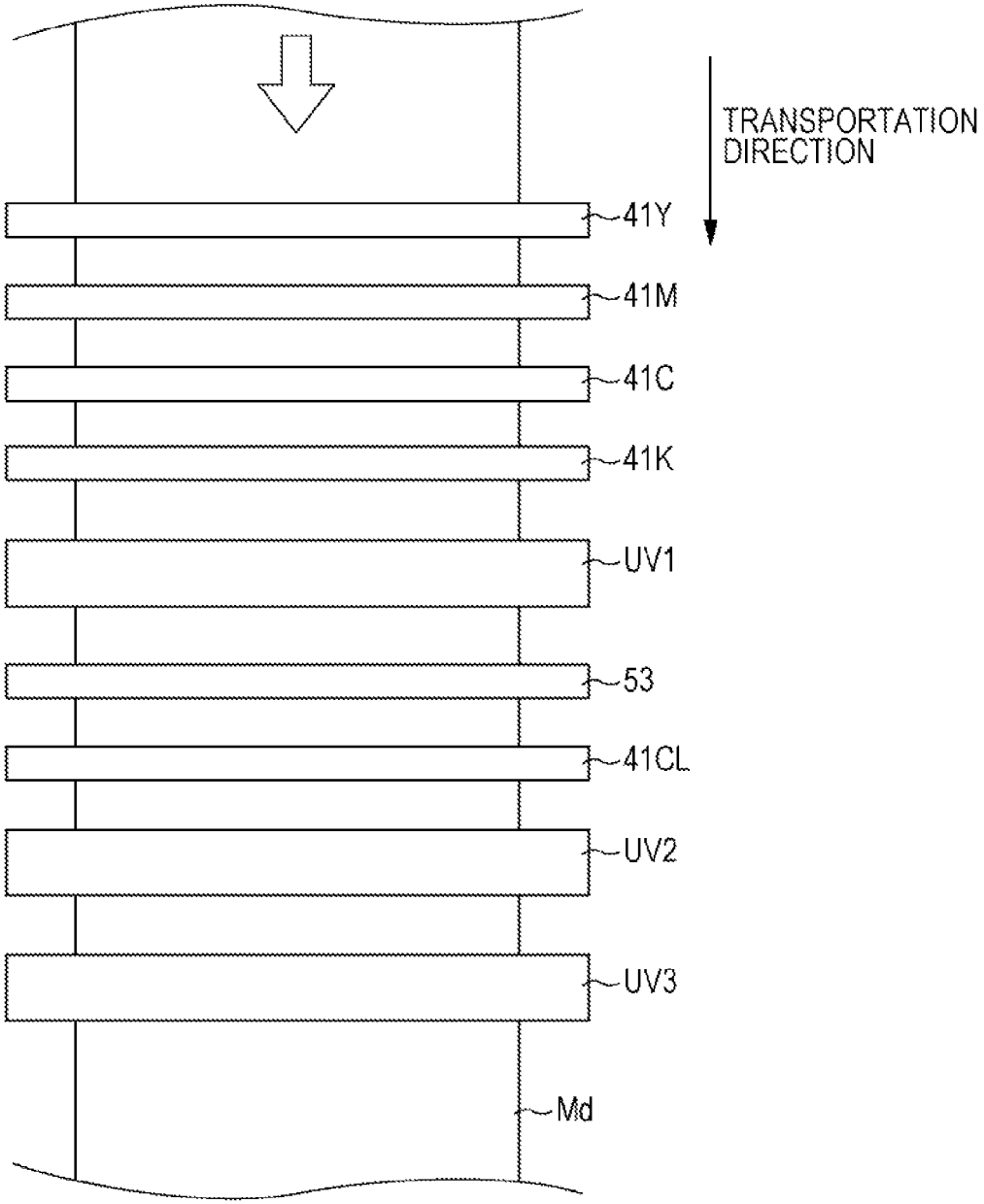
FIG. 3 is a top view when a printer is unfolded along a medium transportation path, according to a first embodiment of the invention.

FIG. 1 is a block diagram illustrating the entire configuration of a printer 1 according to a first embodiment of the invention. FIG. 2 is a side view of the printer 1 according to this first embodiment. FIG. 3 is a top view when the printer 1 is unfolded along a medium transportation path. Hereinafter, a fundamental configuration of the printer 1 according to this first embodiment will be described.

The printer 1 according to this first embodiment includes a transportation unit 20, a head unit 40, a detector group 50 and a controller 60. Upon reception of print data from a computer 110, which is an external apparatus, the printer 1 causes the controller 60 to control individual units (i.e., the transportation unit 20 and the head unit 40). The controller 60 controls the individual units so as to cause the individual units to perform printing onto a medium, such as print paper, on the basis the print data having been received from the computer 110. The states inside the printer 1 are monitored by the detector group 50, which outputs detection results to the controller 60. The controller 60 controls the individual units on the basis of the detection results having been outputted from the detection group 50.

The transportation unit 20 includes a printing drum 21, a paper feeding drum 22 and a winding drum 23. These drums operate in conjunction with one another such that a medium Md which is wound by the paper feeding drum 22 is fed to the printing drum 21, and the medium Md having been completely subjected to printing on the printing drum 21 is wound by the winding drum 23. In addition, the transportation unit 20 includes a plurality of rollers 24A to 24F, and allows these rollers to apply a suitable degree of tension to the medium Md.

An ultraviolet irradiation unit 30 includes a first ultraviolet irradiation unit UV1, a second ultraviolet irradiation unit UV2 and a third ultraviolet irradiation unit UV3, which will be described below. As described below, the first ultraviolet irradiation unit UV1 temporarily hardens color inks landed on a medium. The second ultraviolet irradiation unit UV2 temporarily hardens a clear ink landed on the medium. Further, the third ultraviolet irradiation unit UV3 fully hardens the color inks and the clear ink landed on the medium.

The first ultraviolet irradiation unit UV1 and the second ultraviolet irradiation unit UV2 are each configured such that a plurality of LEDs each irradiating ultraviolet light are arranged. The third ultraviolet irradiation unit UV3 is configured such that, for example, a plurality of metal halide lamps each irradiating ultraviolet light are arranged.

The head unit 40 includes a yellow ink head unit 41Y, a magenta ink head unit 41M, a cyan ink head unit 41C, a black ink head unit 41K and a clear ink head unit 41CL. These are head units each for ejecting an ultraviolet hardening type ink. Further, each of these head units has a head control unit HC for controlling ink ejection operation.

The yellow ink head unit 41Y, the magenta ink head unit 41M, the cyan ink head unit 41C and the black ink head 41K eject a yellow ink, a magenta ink, a cyan ink and a black ink, respectively. These ejection operations enable a color image to be formed on a medium. Moreover, the clear ink head unit 41CL ejects a transparent or translucent ink. This ejection operation enables coating of the color image. Moreover, this ejection operation enables dot grains to be formed on areas on which any ejection operation with respect to the color image is not performed, thereby enabling creation of a matte feeling thereon similar to that on areas on which color ink grains exist.

The detector group 50 includes an image sensor unit 53 and a residual vibration detection circuit 55. The image sensor unit 53 is a kind of scanner unit, and detects color inks existing on a medium. That is, the image sensor unit 53 detects an image which is formed on a medium. Further, the image having been detected and an image to be formed are compared by the controller 60 on a pixel-by-pixel basis. As the result of this comparison, in the case where certain dots of the image to be formed are not formed on the image having been detected, it is found out that there exists an ejection failure in a nozzle through which the certain dots of the image are to be formed. In this way, an ejection failure of any of the nozzles for the color inks is detected by the image sensor unit 53.

Further, the residual vibration detection circuit 55 (which is equivalent to the inspection unit) is a circuit for performing an inspection as to whether or not ejection operations of the clear ink are appropriately performed. The configuration of this residual vibration detection circuit 55 will be described below.

Further, the detector group 50 includes a rotary-type encoder 52 (not illustrated). The rotary-type encoder 52 is attached to a rotation shaft of the printing drum 21, and monitors an amount of rotation of the printing drum 21.

The controller 60 is a control unit for controlling the printer 1. The controller 60 includes an interface unit 61, a CPU 62, a memory 63, a unit control circuit 64, a first driving signal generation circuit 65-1 and a second driving signal generation circuit 65-2.

The interface unit 61 is located between the computer 110, which is an external apparatus, and the printer 1, and transmits and receives data therebetween. The CPU 62 is an arithmetic processing apparatus for controlling the entire printer. The memory 63 is a memory module for ensuring a program storage area and a work area for the CPU 62, and includes memory elements, such as a RAM element and an EEPROM element. The CPU 62 performs control of the individual units via the unit control circuit 64 in accordance with the program stored in the memory 63.

As described below, the first driving signal generation circuit 65-1 generates a first driving signal COM1 for driving the color-ink head units including the yellow ink head unit 41Y to the black ink head unit 41K. Further, the second driving signal generation circuit 65-2 generates a second driving signal COM2 for driving the clear ink head unit 41CL. In addition, here, the first driving signal generation circuit 65-1 for generating the first driving signal COM1 and the second driving signal generation circuit 65-2 are described as mutually different circuits, but may be a common circuit. The first driving signal generation circuit 65-1 and the second driving signal generation circuit 65-2 correspond to the driving signal generation units, respectively.

Further, the controller 60 according to this embodiment also performs processing for determining whether each of nozzles of the clear ink head 41CL is normal or abnormal, on the basis of the result of the detection having been performed by the residual vibration detection circuit 55. Further, the controller 60 also performs processing for determining whether each of nozzles of the color ink head units 41Y to 41K is normal or abnormal, on the basis of the result of the detection having been performed by the image sensor unit 53. That is, the controller 60 plays a partial role of the inspection unit. Further, the controller 60 also corresponds to the control unit for causing the inspection unit to perform an inspection.

The above-described yellow ink head unit 41Y, magenta ink head unit 41M, cyan ink head unit 41C and black ink head unit 41K are serially arranged on the printing drum 21 from the upstream side of a medium transportation direction. In order to temporarily harden color inks existing on the medium, the first ultraviolet irradiation unit UV1 is arranged at the downstream side of the black ink head unit 41K.

Moreover, the image sensor unit 53 is arranged at the downstream side of the first ultraviolet irradiation unit UV1. Furthermore, in order to temporarily harden a clear ink existing on the medium, the second ultraviolet irradiation unit UV2 is arranged at the downstream side of the image sensor unit 53.

Further, in order to fully harden the color inks and the clear ink, the third ultraviolet irradiation unit UV3 is arranged at the most downstream side.

In addition, the temporal hardening operation increases the viscosity of the surfaces of inks droplets having been landed on the medium, and suppresses the movement of the ink droplets. In this way, even when, onto already landed ink droplets, droplets of a different kind of ink are further landed, the increase of the viscosity of the surfaces of the already landed ink droplets makes it hard for the already landed ink droplets adhering to one another to disperse, thereby enabling suppression of the occurrence of bleeding. Further, the fully hardening operation is performed to a degree that does not causes a medium to stick to the medium itself because of ink droplets having been landed thereon when the medium is wound by the winding roller 23.

Outline of Processing performed by Printer Driver

Figure 4:
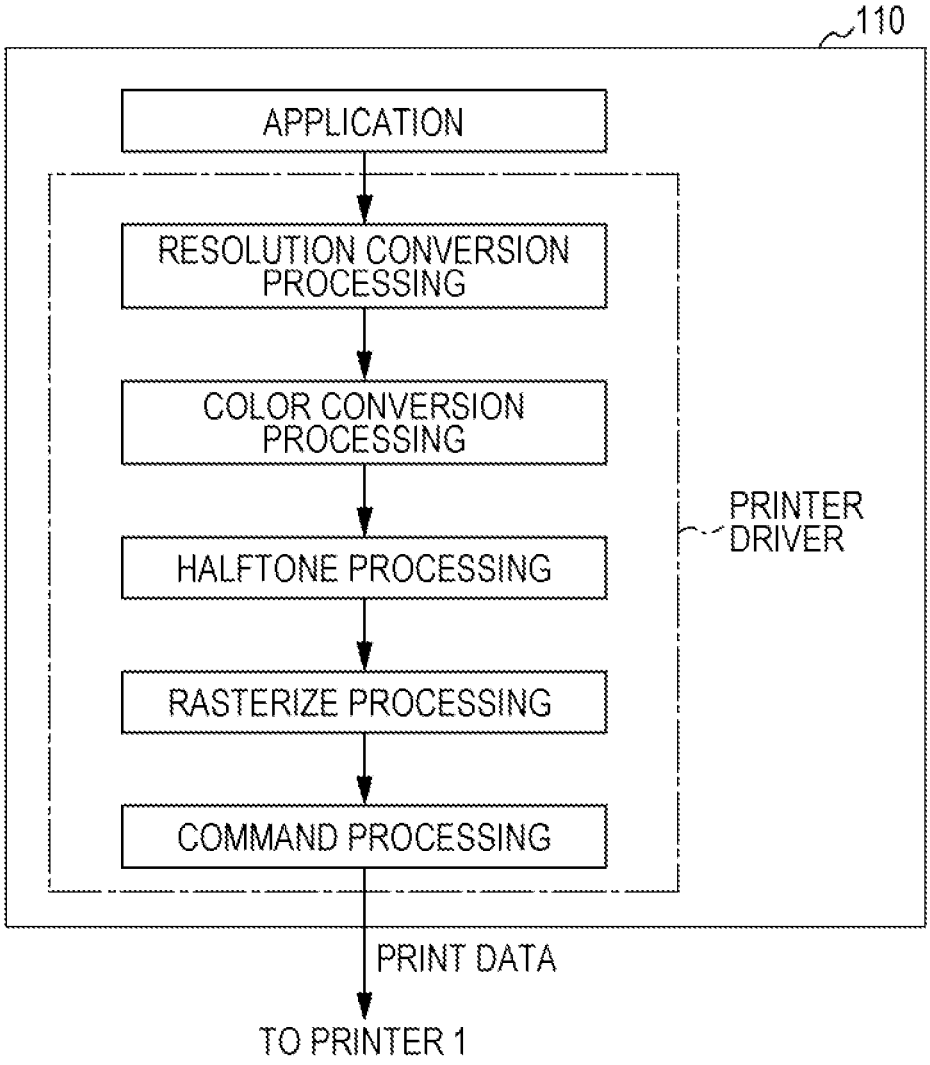
FIG. 4 is a diagram for describing processing performed by a printer driver according to a first embodiment of the invention.

Printing processing starts triggered by the transmission of print data from the computer 110 connected to the printer 1. This print data is generated by a printer driver. Hereinafter, processing performed by the printer driver will be described referring to FIG. 4. FIG. 4 is a diagram illustrating the processing performed by the printer driver.

Upon reception of image data from an application program, the printer driver converts the image data into print data of a format which is interpretable by the printer 1, and outputs the converted print data to the printer 1. When converting the image data having been received from the application program, the printer driver performs resolution conversion processing, color conversion processing, halftone processing, rasterize processing and command addition processing.

The resolution conversion processing is processing for converting a resolution of image data (text data, image data and the like), which has been outputted from an application program, into a resolution (a printing resolution) for printing which is performed onto print paper. For example, when the printing resolution is set to 720×720 dpi, image data in a vector format, having been received from the application program, is converted into image data in a bitmap format, having a resolution of 720×720 dpi. In addition, each pixel data of image data resulting from the resolution conversion processing is multiple grayscale RGB image data (for example, 256-grayscale RGB image data) represented by an RGB color space. A grayscale value of each pixel is determined on the basis of the RGB image data, and will be hereinafter also referred to as an instructed grayscale value.

The color conversion processing is processing for converting the RGB image data into image data represented by a CMYK color space. In addition, the image data represented by the CMYK color space is data corresponding to colors of respective inks provided in the printer. In other words, the printer driver generates image data on a CMYK plane on the basis of the RGB image data.

This color conversion processing is performed on the basis of a table (a color conversion look-up table LUT) in which RGB data grayscale values and CMYK data grayscale values are correlated with each other. In addition, the image data resulting from the color conversion processing is 256-grayscale CMYK image data represented by the CMYK color space.

The halftone processing is processing for converting high grayscale-resolution image data into grayscale-resolution image data based on which the printer is capable of forming a corresponding color image. Through this halftone processing, image data representing 256 grayscale levels is converted into one-bit image data representing two grayscale levels or two-bit image data representing four grayscale levels. In image data resulting from the halftone processing, each pixel corresponds to one-bit image data or two-bit image data, and this image data becomes data representing a dot formation state (the presence or absence of a corresponding dot) and the like with respect to each pixel.

In addition, in this embodiment, as described below, three-bit data representing the size of a dot, as well as, whether or not dot-position shifting is to be performed, is generated as pixel data for each of the color inks. Moreover, three-bit data representing the presence or absence of a dot, as well as, the presence or absence of a nozzle inspection, is generated as pixel data for the clear ink. Subsequently, after a dot generation ratio has been determined with respect to the size of each dot, image data is generated so as to cause dots to be formed dispersively by utilizing a dither method, a gamma correction, an error diffusion method or the like.

The rasterize processing is processing for rearranging image data, which is arranged in a matrix, in accordance with dot formation order at the time of printing. For example, pieces of image data corresponding to respective dot formation processes are extracted, and the extracted pieces of image data are rearranged in accordance with dot formation order.

The command addition processing is processing for adding command data in accordance with a printing method to image data resulting from the rasterize processing. Examples of the command data include transportation data representing a transportation speed of a medium, and the like.

Printing data having been generated as the result of these pieces of processing is transmitted to the printer 1 by the printer driver.

Regarding Configuration of Driving Signal Generation Circuit

In this embodiment, as described above, the first driving signal generation circuit 65-1 and the second driving signal generation circuit 65-2 are used. Since the configurations of these circuits are substantially the same as each other, here, the first driving signal generation circuit 65-1 will be described.

Figure 5:
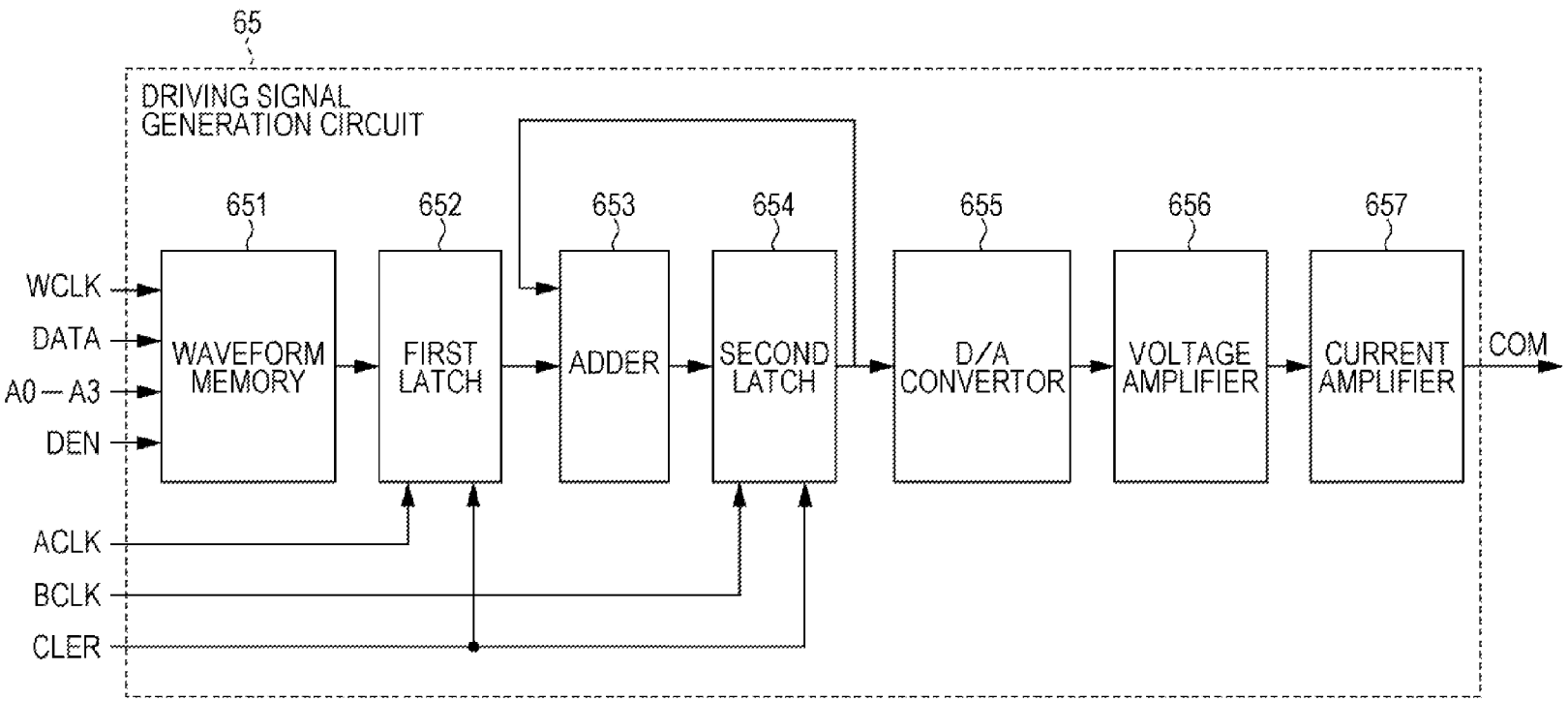
FIG. 5 is a block diagram illustrating a configuration of a driving signal generation circuit according to a first embodiment of the invention.

FIG. 5 is a block diagram illustrating a configuration of the first driving signal generation circuit 65-1. The driving signal generation circuit 65 includes a waveform memory 651, a first latch circuit 652, an adder 653, a second latch circuit 654, a D/A convertor 655, a voltage amplifier 656 and a current amplifier 657.

In addition, the CPU 62 outputs a writing enable signal DEN, a writing clock signal WCLK and writing address data A0 to A3 to the first driving signal generation circuit 65-1, and writes waveform formation data DATA of, for example, 16 bits into the waveform memory 651. Further, the CPU 62 outputs the following address data and clock signals to the driving signal generation circuit 65: reading address data A0 to A3 used for reading out the waveform formation data DATA which is stored in the waveform memory 651; a first clock signal ACLK used for setting timing for latching the waveform formation data DATA having been read out from the waveform memory 651, a second clock signal BCLK used for setting timing for performing addition of the latched waveform data, and a clear signal CLEAR used for clearing the latched data.

The waveform memory 651 is a memory for temporarily storing therein the waveform formation data DATA which is inputted from the CPU 62 and is used for generation of driving signals.

The first latch circuit 652 is a circuit for reading out necessary waveform formation data DATA from the waveform memory 651 by using the first clock signal ACLK described above, and temporarily latching the read-out waveform formation data DATA.

The adder 653 performs arithmetic addition of the output of the first latch circuit 652 and waveform generation data WDATA outputted from the second latch circuit 654 described below.

The second latch circuit 654 latches the output of the arithmetic addition performed by the adder 653 by using the second clock signal BCLK.

The D/A converter 655 converts the waveform generation data WDATA outputted from the second latch circuit 654 into an analog signal.

The voltage amplifier 656 voltage-amplifies the analog signal outputted from the D/A converter 655.

The current amplifier 657 current-amplifies the output signal of the voltage amplifier 656, and outputs the driving signal COM.

In addition, the clear signal CLER, which is outputted from the CPU 62, is inputted to the first latch circuit 652 and the second latch circuit 654, and when this clear signal CLER becomes an off state (a low level), latched data is cleared.

Figure 6:
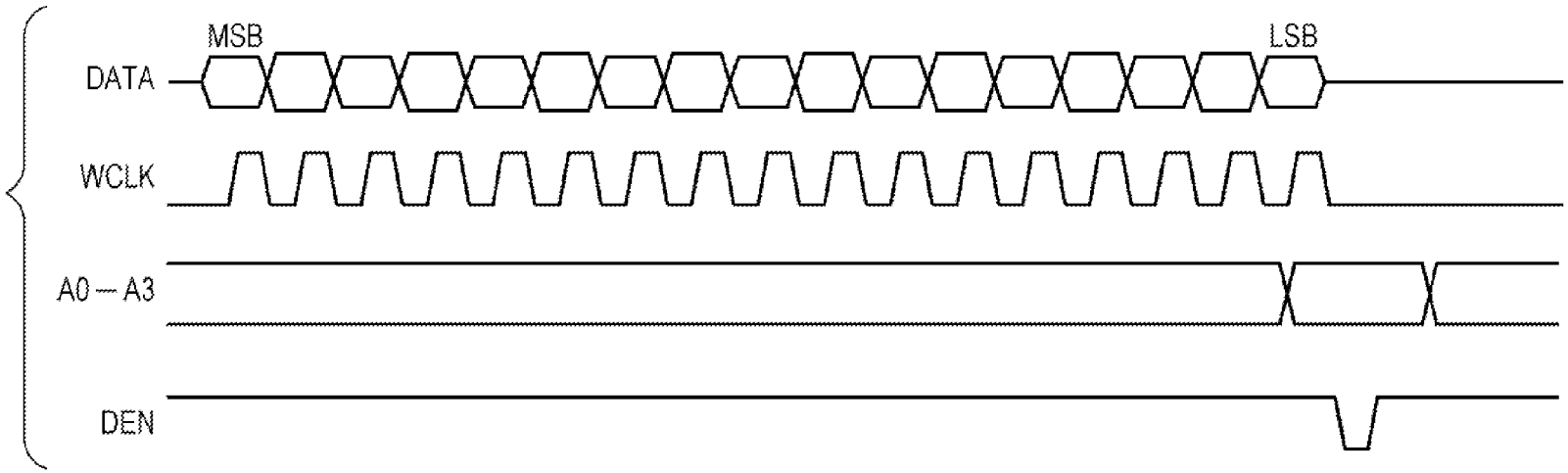
FIG. 6 is a diagram illustrating timing of writing data into a waveform memory, according to a first embodiment of the invention.

FIG. 6 is a diagram illustrating timing of writing data into the waveform memory 651.

As shown in FIG. 6, in the waveform memory 651, a memory element of several bits is arranged at each specified address, and each piece of the waveform data DATA is stored into the memory element specified by corresponding one the addresses A0 to A3. Specifically, each piece of the waveform data DATA is serially inputted to a portion of the waveform memory 651, the portion being addressed by one of the addresses A0 to A3 which is specified by the CPU 62, in synchronization with the clock signal WCLK, and then, the piece of the waveform data DATA is stored into the memory element at the time of input of the writing enable signal DEN.

Figure 7:
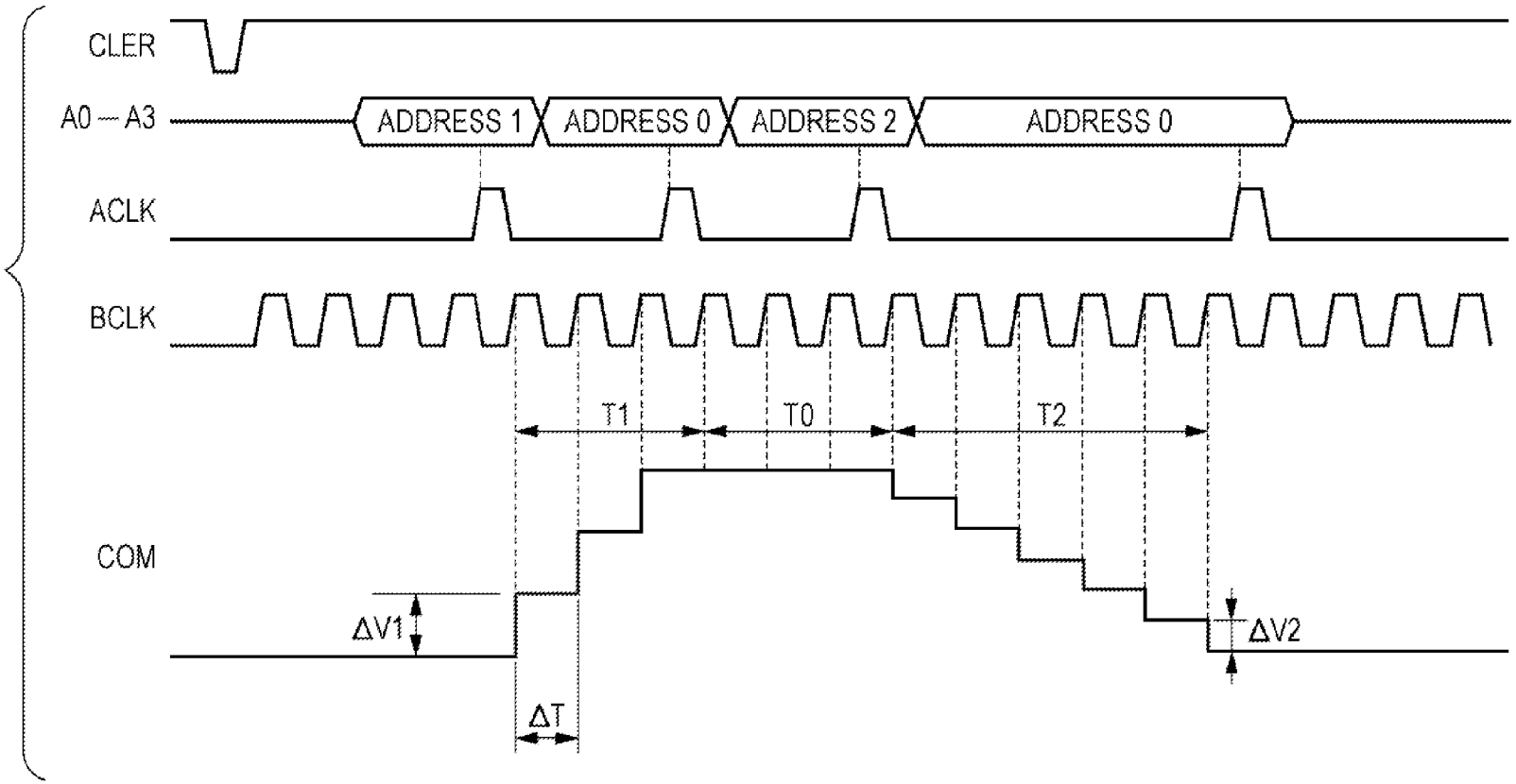
FIG. 7 is a diagram illustrating timing of reading out data from a waveform memory and timing of generation of a driving signal, according to a first embodiment of the invention.

FIG. 7 is a diagram illustrating operation of reading out data from the waveform memory 651, and timing of generating the driving signal COM. In this example, a piece of waveform data, which is equivalent to a voltage "0" as a per-unit-time voltage variation amount, is written in the memory unit corresponding to the address A0. Similarly, pieces of waveform data whose equivalent voltages are voltages +ΔV1, −ΔV2 and +ΔV3 are written in the memory units corresponding to the addresses A1, A2 and A3, respectively. Further, pieces of data stored in the first latch circuit 652 and the second latch circuit 654 are cleared by the clear signal CLER. In addition, it is supposed that the driving signal COM starts from a grounding electric potential.

Under this state, as shown in FIG. 7, when the waveform data corresponding to the address A1 has been read out, and further, the first clock signal ACLK has been inputted, digital data whose equivalent voltage is the voltage +ΔV1 is stored into the first latch circuit 652. The stored digital data whose equivalent voltage is the voltage +ΔV1 is inputted to the second latch circuit 654 through the adder 653, and this second latch circuit 654 stores therein the output of the adder 653 in synchronization with each of the risings of the second clock signal BCLK. Since the output of the second latch circuit 654 is also inputted to the adder 653, the output of the second latch circuit 654 (COM) is added by digital data whose equivalent voltage is the voltage +ΔV1 at timing of each of the risings of the second clock signal BCLK. In this example (FIG. 7), during a time width T1, the waveform data corresponding to the address A1 is read out, so that the output of the second latch circuit 654 (COM) is totally added by digital data whose equivalent voltage is three times the voltage +ΔV1.

Similarly, when the waveform data corresponding to the address A0 has been read out, and further, the first clock signal ACLK has been inputted, digital data stored in the first latch circuit 652 is switched to digital data whose equivalent voltage is the voltage "0". In the same way as described above, this digital data whose equivalent voltage is the voltage "0" is added through the adder 653 at timing of each of the risings of the second clock signal BCLK, but, since a voltage value equivalent to this digital data is "0", the output of the second latch circuit 654 is substantially kept to digital data whose equivalent voltage value is an immediately previous one. In this example, the voltage of the driving signal COM is kept to a constant value during a time width T0.

Subsequently, when the waveform data corresponding to the address A2 has been read out, and further, the first clock signal ACLK has been inputted, the digital data stored in the first latch circuit 652 is switched to digital data whose equivalent voltage is the voltage−ΔV2. This digital data whose voltage is equivalent to the voltage−ΔV2 is added through the adder 653 at timing of each of the risings of the second clock signal BCLK in the same way as described above. Here, since the digital data whose equivalent voltage is the voltage−ΔV2, the voltage of the driving signal COM is substantially subtracted by the voltage−ΔV2 in synchronization with the second clock signal BCLK. In this example, during a time width T2, the digital data corresponding to the driving signal COM is totally subtracted by digital data whose equivalent voltage is six times the voltage−ΔV2.

When the waveform data corresponding to the address A0 has been read out again, and the voltage variation amount has become "0", the voltage of the driving signal COM is kept to an immediately previous value.

In such processing as described above, the driving signal COM is generated. In addition, an ascending portion of the driving signal COM corresponds to a stage in which the capacity of a cavity 423, which will be described blow, is increased to a degree which allows an ink to be flown in, and a descending portion of the driving signal COM corresponds to a stage in which the capacity of the cavity 423 is reduced to a degree which allows ink droplets to be ejected. Incidentally, as easily inferred from the description above, the waveform of the driving signal is adjustable by appropriately selecting each of pieces of waveform data to be written into the portions corresponding to the addresses A0 to A3 from among the pieces of digital data whose equivalent voltages are "0", +ΔV1, −ΔV2, +ΔV3, as well as appropriately adjusting the timing points of the first clock signal ASCK and the second clock signal BSCK.

Configuration of Head Unit

Figure 8:
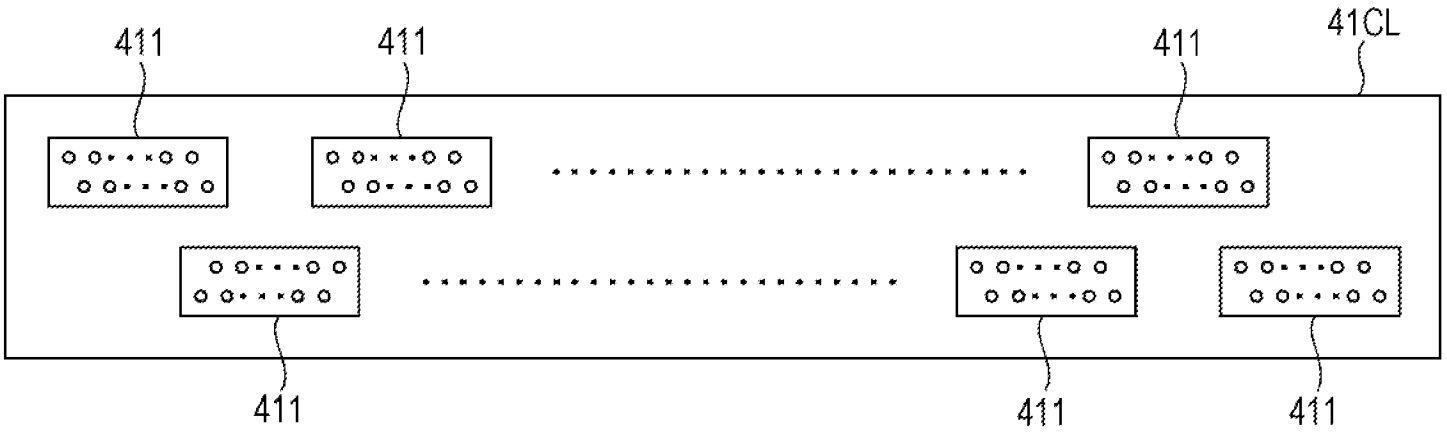
FIG. 8 is a diagram illustrating an example of an arrangement of nozzles on a bottom face of a head unit, according to a first embodiment of the invention.

FIG. 8 is a diagram illustrating an example of an arrangement of nozzles at the bottom face of a head unit. In this embodiment, the printer 1 includes the yellow ink head unit 41M, a magenta ink head unit 41Y, a cyan ink head unit 41C, a black ink head unit 41K and a clear ink head unit 41CL. The external view configurations of these units are substantially the same, and thus, here, the clear ink head unit 41CL is taken as an example and will be described below.

The clear ink head unit 41CL includes a plurality of heads 411. As shown in FIG. 8, the plurality of heads 411 is arranged in a so-called zigzag pattern. This arrangement enables ejection of an ink across the entire width direction of a medium.

Further, two rows of nozzles are formed in each of the heads 411. The nozzles, which are formed in these two nozzle rows, are also arranged in a so-called zigzag pattern. This arrangement enables realization of a nozzle pitch of, for example, 720 dpi with respect to the width direction of a medium (i.e., in the direction intersecting with a medium transportation direction).

In addition, the head 411 according to this embodiment adopts a method using a piezoelectric actuator (which is a so-called piezo method), and a piezoelectric actuator is provided so as to correspond to each of the nozzles.

Figure 9:
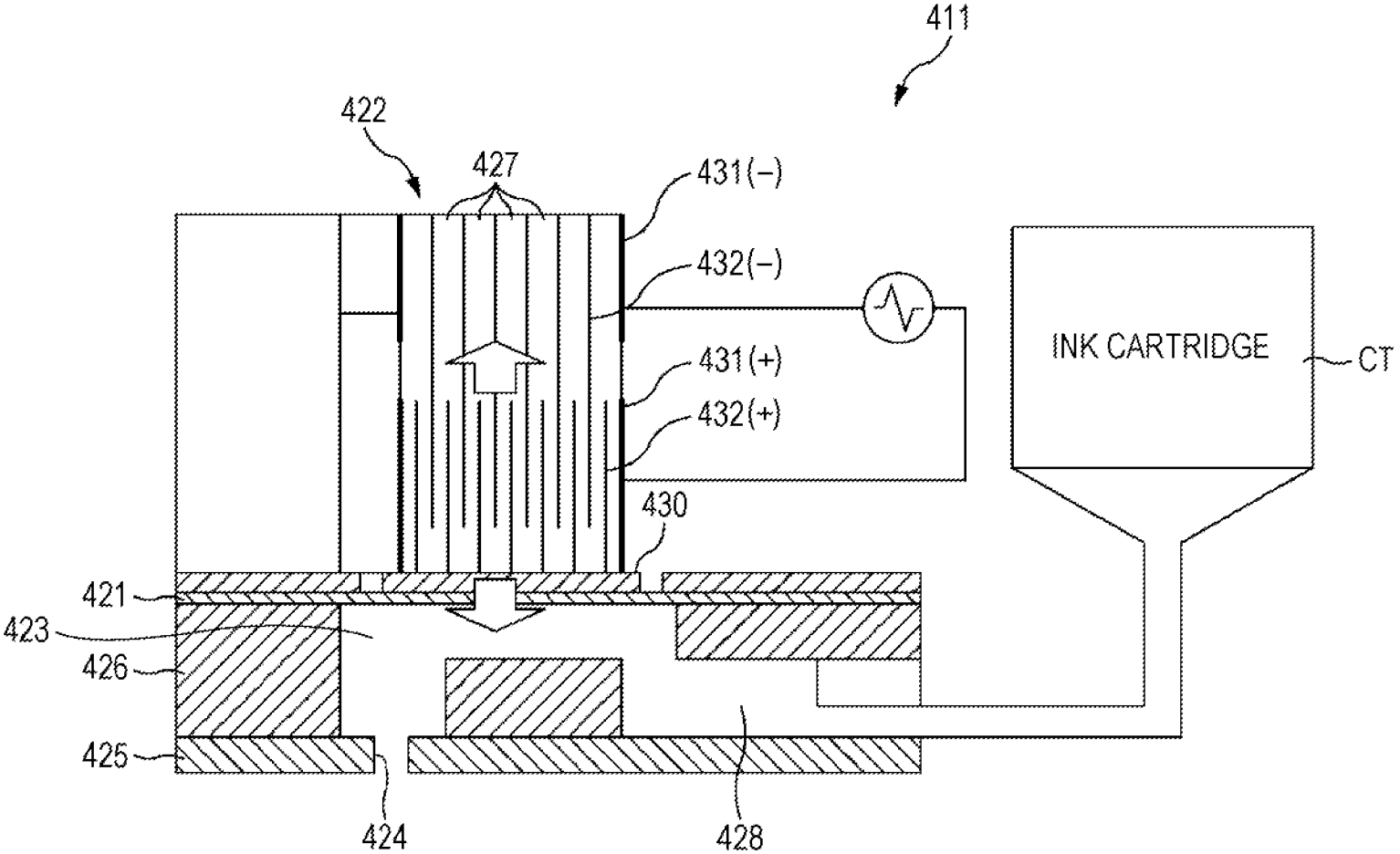
FIG. 9 is a cross-sectional view of an area around a nozzle of a head, according to a first embodiment of the invention.

FIG. 9 is a cross-sectional view of an area around a nozzle of the head 411.

As shown in FIG. 9, the head 411 at least includes a vibration plate 421; a piezoelectric actuator 422 which displaces this vibration plate 421; a cavity (a pressure chamber) 423 inside which an ink as a liquid is filled, and further an internal pressure increases and decreases in conjunction with the displacement of the vibration plate 421; a nozzle 424 which is communicated with this cavity 423, and further ejects the ink as liquid droplets in conjunction with the increase and decrease of the internal pressure inside the cavity 423.

Further describing in detail, the head 411 includes a nozzle substrate 425 in which the nozzle 424 is formed; a cavity substrate 426; the vibration plate 421; and the laminate-type piezoelectric actuator 422 having a laminated plurality of piezoelectric elements 427. The cavity substrate 426 is formed into a given shape shown in FIG. 9, in accordance with which the cavity 423 and a reservoir 428 communicated with this cavity 423 are formed. Further, the reservoir 428 is connected to an ink cartridge CT via an ink feeding tube 429. The piezoelectric actuator 422 includes a comb-teeth shaped first electrode 431 and a comb-teeth shaped second electrode 432, which are located opposite to each other. Moreover, the piezoelectric actuator 422 includes piezoelectric elements 427 which are arranged such that the piezoelectric elements 427 themselves and the comb-teeth shaped electrodes of the first electrode 431 and the second electrode 432 are alternately located. Further, as shown in FIG. 9, an edge portion of the piezoelectric actuator 422 is coupled to the vibration plate 421 via an intermediate layer 430.

With respect to the piezoelectric actuator 422 configured in such a way as described above, a mode, in which, when the driving signal COM is applied between the first electrode 431 and the second electrode 432, the piezoelectric elements 427 expand and contract in an upward and downward direction, such as indicated by arrows of FIG. 9, is used. Accordingly, the piezoelectric actuator 422 is configured such that, when the driving signal COM is applied, a displacement of the vibration plate 421 occurs because of the expansion and contraction of the piezoelectric actuator 422, and this displacement causes the pressure inside the cavity 423 to vary, thereby causing ink droplets to be ejected through the nozzle 424. Specifically, as described below, an ink is flown in by expanding the capacity of the cavity 423, and subsequently, ink droplets are ejected by contracting the capacity of the cavity 423. In addition, the ejection unit includes the cavity (pressure chamber) 423, the nozzle 424 and the reservoir 428.

Figure 10:
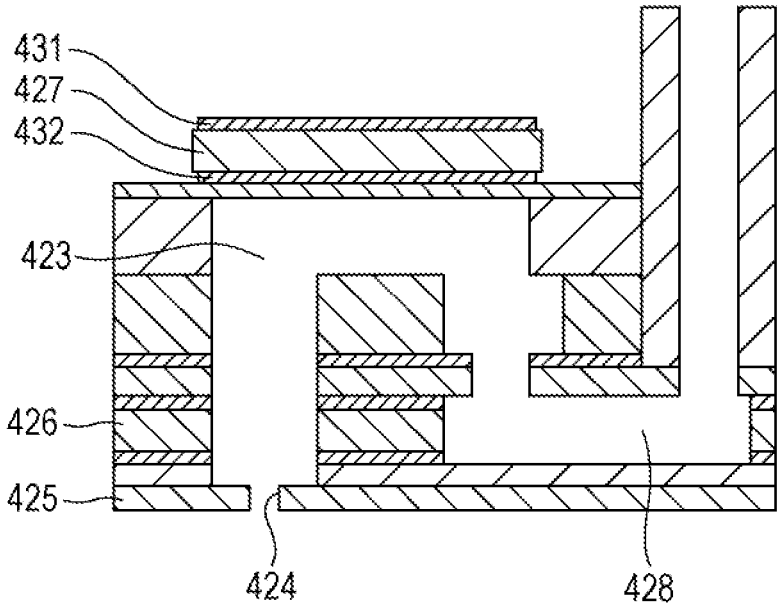
FIG. 10 is a diagram illustrating another example of a piezoelectric actuator according to a first embodiment of the invention.

FIG. 10 is a diagram illustrating another example of the piezoelectric actuator 422. In addition, reference signs shown in FIG. 10 are the same as those of FIG. 9. A piezoelectric actuator shown in FIG. 10 is generally called a unimorf-type actuator, and has a simple structure in which the piezoelectric element 427 is interposed between two electrodes (the first electrode 431 and the second electrode 432). In such a configuration as shown in FIG. 10, when a driving signal is applied, the piezoelectric element 427 bends in an upward and downward direction of the figure. This causes displacements of the vibration plate 421, thereby causing ink droplets to be ejected, just like in the case of the laminate-type actuator shown in FIG. 9. In this case, similarly, an ink is flown in by expanding the capacity of the cavity 423, and subsequently, ink droplets are ejected through the nozzle 424 by contracting the capacity of the cavity 423.

With respect to the printer 1 provided with the head 411 configured in such a way as described above, sometimes, there occurs a phenomenon in which ink droplets are not ejected through the nozzle 24 at the time when the ink droplets are to be ejected (an ejection failure), that is, a failure in an ink-droplet ejection operation (which is known as a dot lacking phenomenon), because of the shortage of ink, the viscosity increase of ink, the occurrence of air-bubbles, clogging (desiccation) or the like. In order to detect such an ejection failure, it is necessary to perform a nozzle inspection.

Regarding Nozzle Inspection

When the driving signal COM has been applied to the piezoelectric actuator 422 corresponding to each of the nozzles 424, subsequent to a pressure variation caused thereby, a residual vibration occurs inside the cavity 423 (to be exact, a free vibration of the vibration plate 421 shown in FIG. 9). It is possible to detect the state of each of the nozzles 424 (including the state inside the cavity 423) from the state of the residual vibration.

Figure 11:
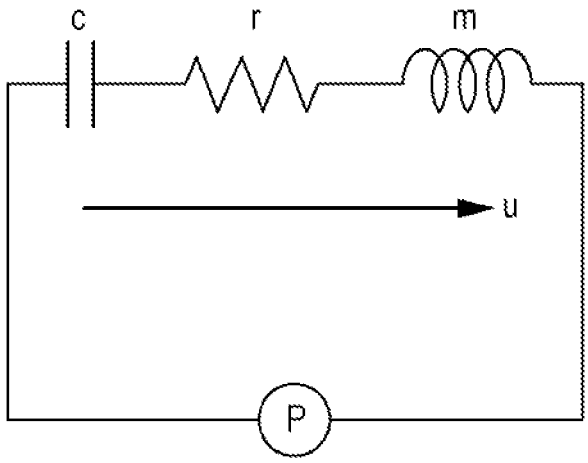
FIG. 11 is a diagram illustrating a calculation model of a simple vibration when a residual vibration of a vibration plate is supposed, according to a first embodiment of the invention.

FIG. 11 is a diagram illustrating a calculation model of a single vibration when a residual vibration of the vibration plate 421 is supposed.

When the driving signal COM (a driving pulse) has been applied to the piezoelectric actuator 422, the piezoelectric actuator 422 expands and contracts in accordance with the voltage of the driving signal COM. The vibration plate 421 bends in conjunction with the expansion and contraction of the piezoelectric actuator 422, thereby causing the capacity of the cavity 423 to contract subsequent to an expansion. At this time, a pressure caused thereby inside the pressure chamber causes part of an ink filling the cavity 423 to be ejected through the nozzle 424 as ink droplets. During this series of operation with respect to the vibration plate 421, the vibration plate 421 causes a free vibration (a residual vibration) at a natural vibration frequency which is determined by a flow-path resistance r due to the shape of an ink feed opening, the viscosity of an ink, and the like, an inertance m due to the weight of an ink inside a flow path, and a compliance c of the vibration plate 421.

A calculation model of the residual vibration of this vibration plate 421 can be represented by a pressure P and the above-described inertance m, compliance C and flow-path resistance r. Calculating a step response with respect to a volume velocity u at the time when a circuit shown in FIG. 11 is supplied with the pressure P results in the following formulas (1), (2) and (3).

$$u = \frac{P}{\omega \cdot m} e^{-\omega t} \cdot \sin\omega t \tag{1}$$

$$\omega = \sqrt{\frac{1}{m \cdot C} - \alpha^2} \tag{2}$$

$$\alpha = \frac{r}{2m} \tag{3}$$

Figure 12:
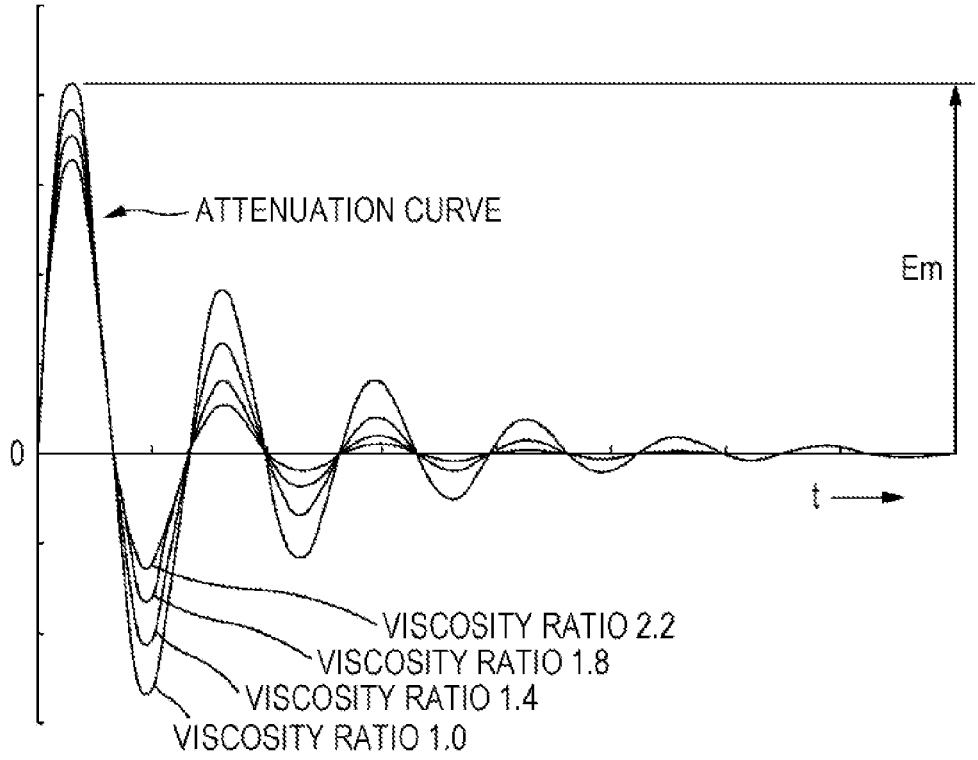
FIG. 12 is a diagram for describing a relation between a viscosity increase of ink and a residual vibration waveform.

FIG. 12 is a diagram for describing a relation between the viscosity increase of an ink and the waveform of a residual vibration. In FIG. 12, a horizontal axis indicates a time and a vertical axis indicates the magnitude of a residual vibration. When, for example, an ink around the nozzle 424 is desiccated, the viscosity of the ink increases (that is, the occurrence of a viscosity increase). The occurrence of the viscosity increase leads to the increase of the flow-path resistance r, resulting in shortening a vibration period and increasing an attenuation amount with respect to the residual vibration.

Figure 13:
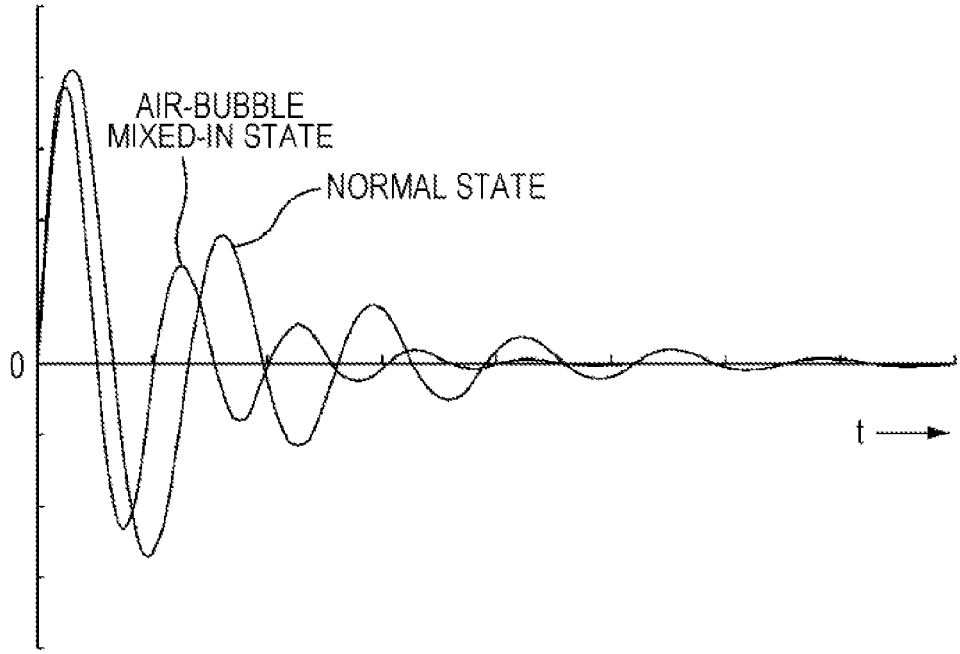
FIG. 13 is a diagram for describing a relation between an air-bubble mixture and a residual vibration waveform.

Further, FIG. 13 is a diagram for describing a relation between an air-bubble mixture and the waveform of a residual vibration. In FIG. 13, a horizontal axis indicates a time and a vertical axis indicates the magnitude of a residual vibration.

For example, when air bubbles are mixed into the flow-path of an ink or the edge of a nozzle, a weight of the ink m (i.e., an inertance) decreases by a weight equivalent to the mixed air bubbles, as compared with a weight of the ink under the state where the nozzle is normal. According to the formula (2), as the m decreases, an angular velocity co increases, and thus, a vibration cycle becomes shorter (a vibration frequency becomes higher).

In such a case, typically, ink droplets are not ejected through the nozzle 424. As a result, a dot lacking phenomenon occurs on an image having been printed on print paper S. Further, even when ink droplets are ejected through the nozzle 424, the amount of the ejected ink droplets are insufficiently small, or the ejected ink droplets are sometimes not landed on target positions because of the misalignments of flight directions (ballistic trajectories) thereof. In this embodiment, a nozzle in such a state will be called a failure (ejection failure) nozzle.

As described above, a residual vibration in such a failure nozzle is different from a residual vibration in a normal nozzle. In the printer 1 according to this embodiment, therefore, a nozzle inspection (an inspection for an ejection failure) is performed on the transparent clear ink by causing the residual vibration detection circuit 55 to detect such a residual vibration inside the cavity 423 as described above.

Regarding Residual Vibration Detection Circuit

Figure 14:
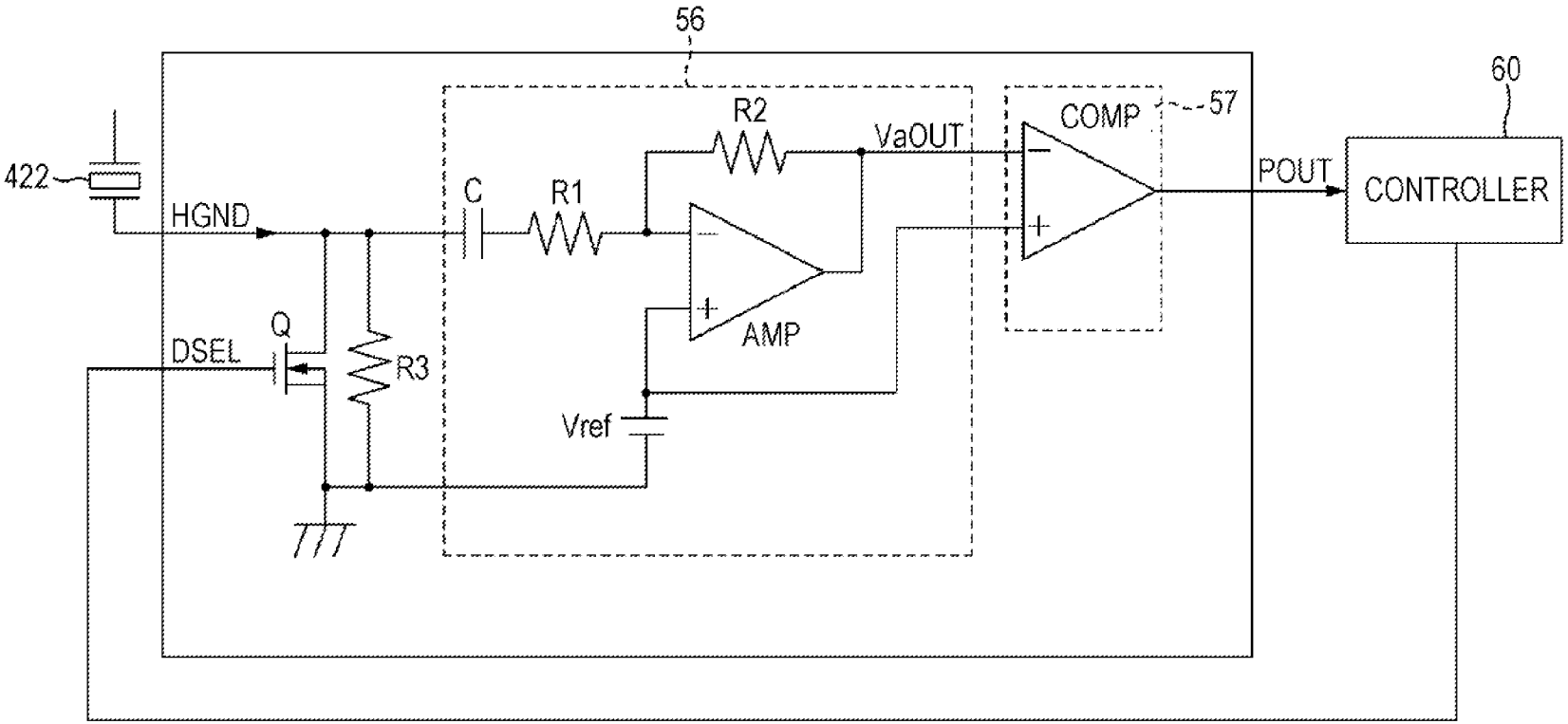
FIG. 14 is a diagram illustrating an example of a configuration of a residual vibration detection circuit according to a first embodiment of the invention.

FIG. 14 is a circuit diagram illustrating an example of a configuration of the residual vibration detection circuit 55. In addition, the residual vibration detection circuit 55 is provided in common with individual nozzles for the clear ink.

The residual vibration detection circuit 55 is a circuit which detects a residual vibration by utilizing a mechanism in which a pressure variation inside the cavity 423 is transmitted to the piezoelectric actuator 422. Specifically, the residual vibration detection circuit 55 detects the variation of an electromotive force (an electromotive voltage), which is occurred by the mechanical displacement of the piezoelectric actuator 422. This residual vibration detection circuit 55 is configured to include a switch (a transistor Q) which grounds or opens a ground side terminal (an HGND applying side terminal) of the piezoelectric actuator 422, an alternate-current amplifier 56 which amplifies alternate-current elements of the residual vibration occurring as the result of opening the ground terminal subsequent to applying a pulse of the driving signal COM to the piezoelectric actuator 422, and a comparator 57 which compares a residual vibration VaOUT resulting from the amplification with a reference voltage Vref. The alternate-current amplifier 56 among these components is constituted by a capacitor C which removes a direct-current element, and an operational amplifier AMP which performs inversion amplification with a gain determined by resistors R1 and R2, relative to an electric potential of the reference voltage Vref as a reference voltage. Further, the resistor R3 is provided in order to suppress a rapid voltage change occurring at each of switching operations of the transistor Q to its on-state and to its off-state.

In such a configuration as described above, when a gate voltage (a gate signal DSEL) of the transistor Q included in the residual vibration circuit 55 is turned to a high level (hereinafter, also referred to as H level), the transistor Q is turned on, so that the ground side terminal of the piezoelectric actuator 422 is in a grounded state and the driving signal COM is supplied to the piezoelectric actuator 422. Meanwhile, when the gate voltage (the gate signal DSEL) of the transistor Q included in the residual vibration circuit 55 is turned to a low level (hereinafter, also referred to as L level), the transistor Q is turned off, so that an electromotive force of the piezoelectric actuator 422 is extracted by the residual vibration detection circuit 55. Further, the residual vibration is detected by the residual vibration detection circuit 55, and the detection result thereof is outputted as a pulse POUT. In addition, a reference sign HGND in the figure denotes a signal line (a ground line) connected to the ground side terminal of the piezoelectric actuator 422.

Figure 15:
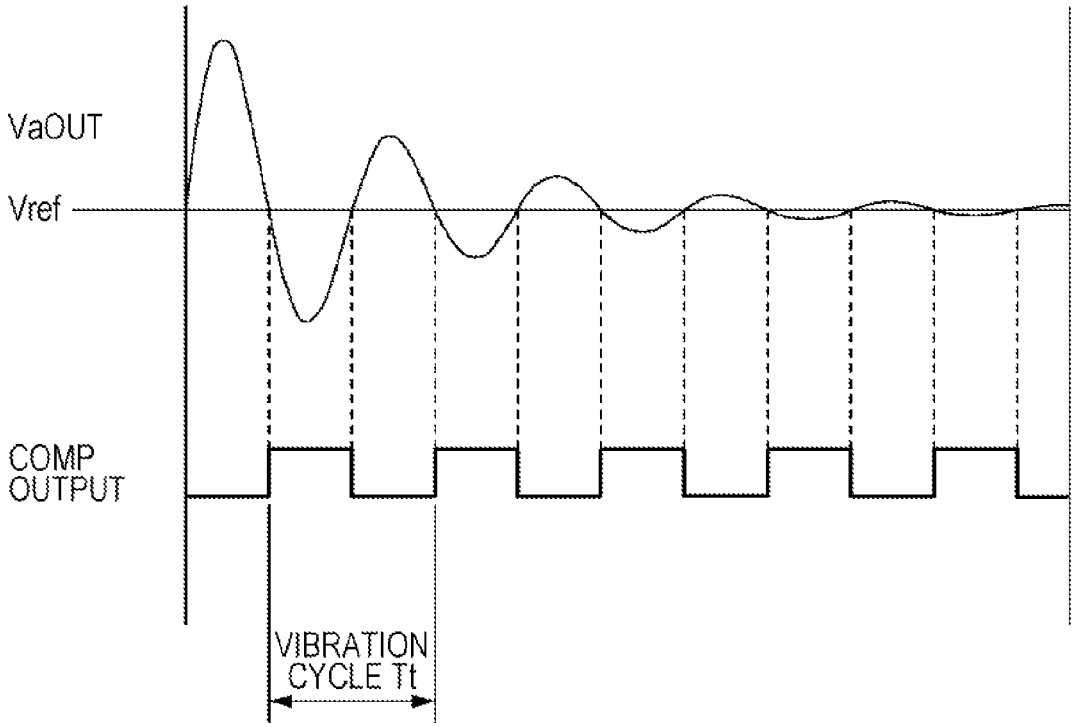
FIG. 15 is a diagram illustrating an example of a relation between an input and an output of a residual vibration detection circuit, according to a first embodiment of the invention.

FIG. 15 is a diagram illustrating an example of a relation between an input and an output of the comparator 57 of the residual vibration detection circuit 55.

The reference voltage Vref is applied to a non-inverse input terminal (+terminal) of the comparator 57, and the residual vibration VaOUT is applied to an inverse input terminal (−terminal). The comparator 57 outputs H level if the voltage of the +terminal (Vref) is larger than the voltage of the −terminal (VaOUT); while the comparator 57 outputs L level if the voltage of the +terminal (Vref) is smaller than the voltage of the −terminal (VaOUT). As a result, as shown in FIG. 15, pulses (COMP output) in accordance with the vibration of the residual vibration VaOUT are outputted. In this embodiment, an inspection of the nozzle 424 is performed on the basis of a pulse cycle (a vibration cycle Tt) of this pulse output (COMP output).

In addition, as shown in FIG. 12, the pulse cycle (vibration cycle Tt) does not change depending on the viscosity increase. In this case, therefore, the inspection is performed by counting the number of pulses (which are pulses detected by the residual vibration detection circuit 55). For example, in the case where the viscosity increase ratio is large, since an attenuation ratio of the pulse is larger as compared with the case where the viscosity increase ratio is small, the number of the pulses becomes small. Thus, it is possible to perform an inspection with respect to the viscosity increase on the basis of the number of the detected pulses.

Regarding Configuration of Head Controller

Figure 16:
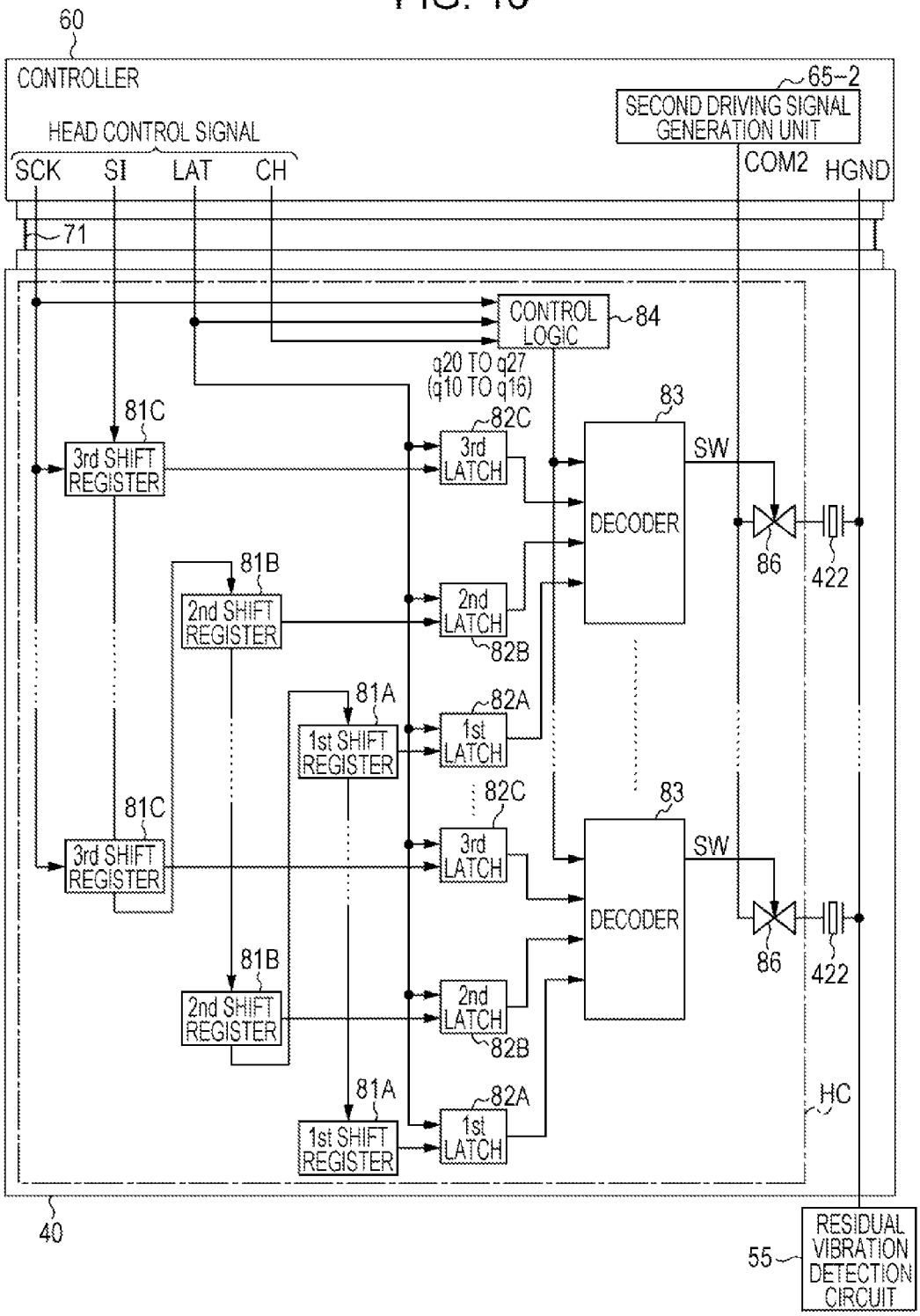
FIG. 16 is a diagram illustrating an example of a configuration of a head control unit of a head unit according to a first embodiment of the invention.

FIG. 16 is a diagram for describing an example of a configuration of the head control unit HC of the head unit 40. In this embodiment, the head control unit HC is provided for each of the ink colors. That is, the head control unit HC is provided for each of the head units. Here, description will be made taking the head control unit HC for the clear ink as an example.

The head control unit HC shown in FIG. 16 includes a first shift register 81A, a second shift register 81B, a third shift register 81C, a first latch circuit 82A, a second latch circuit 82B, a third latch circuit 82C, a decoder 83, a control logic 84 and a switch 86. In addition, the above units except for the control logic 84 are provided for the respective piezoelectric actuators 422 (i.e., for the respective nozzles 424).

In FIG. 16, the residual vibration detection circuit 55 is illustrated. In addition, this residual vibration detection circuit 55 is not provided in each of the control units HCs for the corresponding color inks. This is because, with respect to each of the color inks, the ejection failure thereof is detected by the image sensor unit 53.

In addition, the residual vibration detection circuit 55 according to this embodiment is provided in common with the nozzles 424 for the clear ink, and the signal line (the ground line HGND) connected to the ground side terminal of each of the piezoelectric actuators 422s is inputted to the residual vibration detection circuit 55.

In this embodiment, a flexible cable 71 include transmission lines for the driving signal COM, a latch signal LAT, a channel signal CH, pixel data SI, a shift clock SCK and the ground line HGND. Further, the driving signal COM, the latch signal LAT, the channel signal CH, the pixel data SI and the shift clock SCK are transmitted to the head control unit HC from the controller 60 via the individual transmission lines included in the flexible cable 71. Hereinafter, these signals will be described.

The latch signal LAT is a signal indicating a repeated cycle T (i.e., a period during which a medium is transported by an interval corresponding to a pixel). The latch signal LAT is generated by the controller 60 on the basis of signals from the rotary-type encoder which are outputted in accordance with the rotation of the printing drum 21, and is inputted to the control logic 84 and the latch circuits (the first latch circuit 82A, the second latch circuit 82B and the third latch circuit 82C). The change signal CH is a signal indicating periods during each of which driving pulses included in the driving signal COM are applied to the piezoelectric actuator 422. The change signal CH is also generated by the controller 60 on the basis of signals from the rotary-type encoder which are outputted in accordance with the rotation of the printing drum 21, and is inputted to the control logic 84.

For each of the color inks, the pixel data SI is a signal which specifies, for each pixel, whether or not a position of a corresponding dot is to be shifted, as well as a dot size of the corresponding pixel. Further, for the clear ink, the pixel data SI is a signal which specifies, for each pixel, whether or not a nozzle inspection using a corresponding dot is performed, as well as a dot size of the corresponding pixel. This pixel data SI includes three bits for each of the nozzles 424s. For example, in the case where 64 nozzles exist, the pixel data SI having a size of 3 bits×64 is transmitted from the controller 60 at intervals of the repeated cycle T. In addition, the pixel data SI is inputted to the first shift register 81A, the second shift register 81B and the third shift register 81C in synchronization with the shift clock SCK.

The shift clock SCK is a signal used for setting the pixel data SI and the channel signal CH transmitted from the controller 60 into the control logic 84 and the individual shift registers (the first shift register 81A, the second shift register 81B and the third shift register 81C).

Next, signals generated in the head control unit HC will be described. In the head control unit HC, selection signals q20 to q27 (q10 to q16 for each of the color inks), switch control signals SWs and applied signals are generated.

The selection signals q20 to q27 are generated by the control logic 64 on the basis of the latch signal LAT and the change signal CH. Further, the generated selection signals q20 to q27 are inputted to each of the decoders 83s which are provided for the respective piezoelectric actuators 422s.

Each of the switch control signals SWs is a signal resulting from selecting any one of the selection signals q20 to q27 on the basis of pixel data (three bits) having been latched in the individual latch circuits (the first latch circuit 82A, the second latch circuit 82B and the third latch circuit 82C). The switch control signals SWs having been generated by the respective decoders 83s are inputted to the corresponding switches 86s.

The applied signals are outputted from the corresponding switches 86s on the basis of the driving signals COM and the corresponding switch control signals SWs. These applied signals are inputted to the piezoelectric actuators 422s corresponding to the switches 86s, respectively.

Regarding Operation of Head Control Unit HC

The head control unit HC performs control for causing a corresponding ink to be ejected, as well as, with respect to the clear ink, control for causing a nozzle inspection to be performed, on the basis of the pixel data SI from the controller 60. That is, the head control unit HC performs control of turning on/off of each of the switches 86s on the basis of print data, and thereby, causes necessary portions (periods) of the driving signal COM to be selectively applied to corresponding one of the piezo electric actuators 422s. In other words, the head controller HC performs control of each of the piezoelectric actuators 422s.

In this embodiment, the pixel data SI for each pixel is composed of three bits. Further, this pixel data SI is transmitted to each of the heads 41s in synchronization with the shift clock SCK. Moreover, groups of high-level bits, groups of middle-level bits and groups of low-level bits of the pixel data SI are set into the first shift registers 81As, the second shift registers 81Bs and the third shift registers 81Cs, respectively. The first shift registers 81As, the second shift registers 81Bs and the third shift registers 81Cs are electrically connected to the first latch circuits 82As, the second latch circuits 82Bs and the third latch circuits 82Cs, respectively. Further, when the latch signal LAT from the controller 60 has become H level, the first latch circuits 82As, the second latch circuits 82Bs and the third latch circuits 82Cs perform latching of corresponding high-level bits (SIHs), corresponding middle-level bits (SIMs) and corresponding low-level bits (SILs) of the pixel data SI, respectively.

The three bits of the pixel data SI (which is a set of a high-level bit, a middle-level bit and a low-level bit), the three bits having been latched in any one of the first latch circuits 82As, any one of the second latch circuits 82Bs and any one of the third latch circuits 82Cs, respectively, are inputted to corresponding one of the decoders 83s. Each of the decoders 83s selects any one of the selection signals q20 to q27, which are outputted from the control logic 84, in accordance with the three bits of the pixel data SI which are latched in any one of the first latch circuits 82As, any one of the second latch circuits 82Bs and any one the third latch circuits 82Cs, respectively, and outputs the selected selection signal as the switch control signal SW. Each of the switches 86s is turned on/off in accordance with the switch control signal SW, and selectively applies necessary portions of the driving signal COM to the corresponding piezoelectric actuator 422.

Figure 17A:
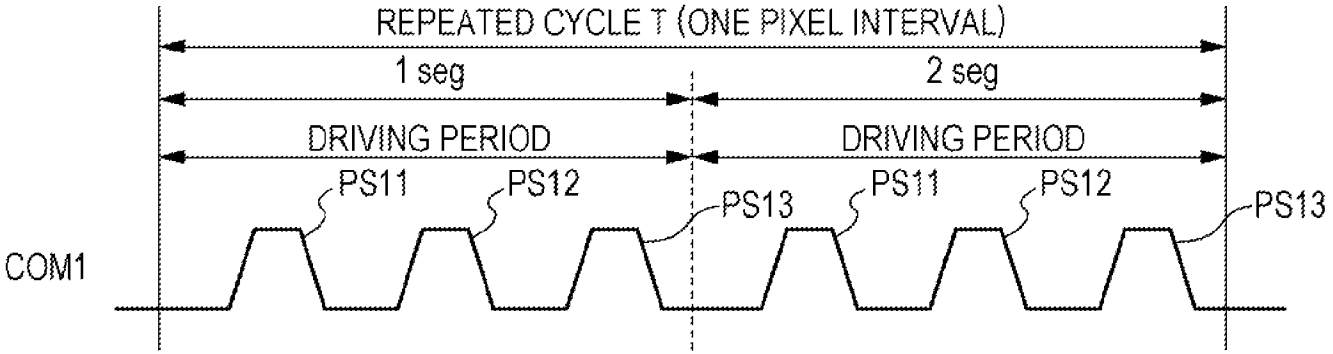
FIG. 17A is a diagram for describing a first driving signal according to a first embodiment of the invention.

FIG. 17A is a diagram for describing a first driving signal COM1. In FIG. 17A, the first driving signal COM1 used for the ejection of each of the color inks is illustrated. The first driving signal COM1 is repeatedly outputted at intervals of the repeated cycle T. The repeated cycle T is segmented into two segments of a 1seg and a 2seg (each corresponding to the "interval").

In the first driving signal COM1, each segment includes a first driving pulse PS11, a second driving pulse PS12 and a third driving pulse PS13. Here, the shapes of these three driving pulses are substantially the same.

As described below, with respect to the first driving signal COM1, during one repeated cycle, any one of the 1seg and the 2seg is selectively used. For example, the 1seg is usually selected, and the 2seg is selected when a position at which a corresponding dot is to be formed is fine-adjusted.

Figure 17B:
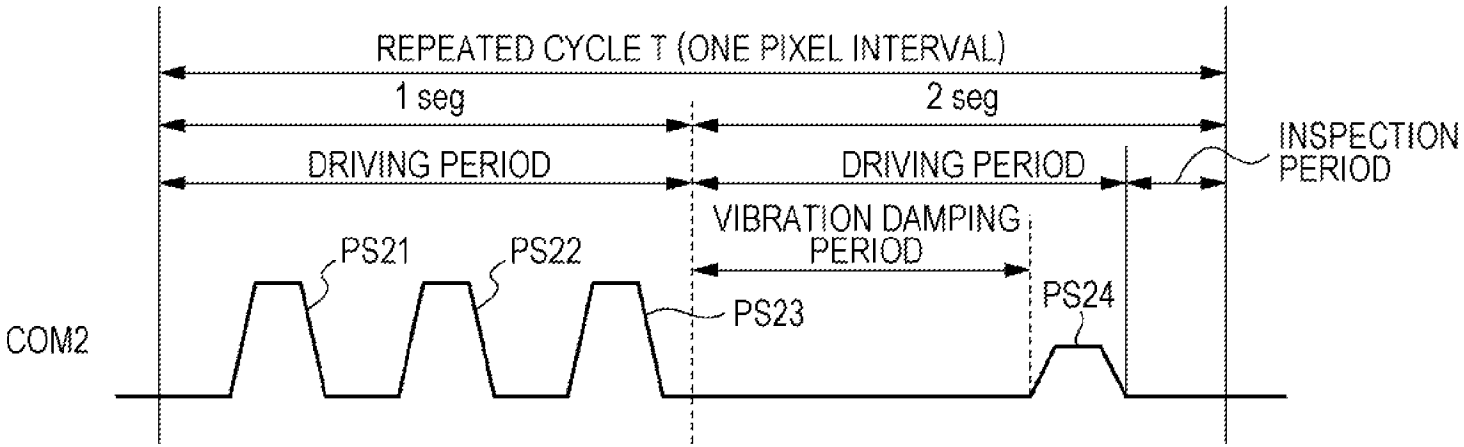
FIG. 17B is a diagram for describing a second driving signal according to a first embodiment of the invention.

FIG. 17B is a diagram for describing a second driving signal COM2. In FIG. 17B, the second driving signal COM2 used for the ejection of the clear ink and the nozzle inspection is illustrated. The second driving signal COM2 is also repeatedly outputted at intervals of the repeated cycle T which is the same as that of the first driving signal COM1. The repeated cycle T is segmented into two segments of the 1seg and the 2seg.

In the second driving signal COM2, the 1seg includes a first driving pulse PS21, a second driving pulse PS22 and a third driving pulse PS23. Here, the shapes of these three driving pulses are substantially the same.

Further, the 2seg includes a fourth driving pulse PS24. The fourth driving pulse PS24 is a driving pulse which is used for the nozzle inspection for the clear ink, and which does not eject any ink. In the 2seg, there is provided a vibration damping period during the corresponding piezoelectric actuator 422, to which a last driving pulse was applied during the 1seg, has been completely damped, and after an elapse of this damping period, the fourth driving pulse PS24 is generated. Further, a period from the completion of the generation of the fourth driving pulse PS24 until the end of the repeated cycle T is an inspection period using the fourth driving pulse PS24.

In the second driving signal COM2, the clear ink is ejected during the 1seg, and further, the 2seg is also used when the nozzle inspection for nozzles through each of which the clear ink is ejected is performed.

FIG. 18 is a diagram for describing the pixel data SI for each of the color inks. The above-described pixel data SI is represented by three bits. The highest-level bit is a bit indicating whether or not dot-position sifting is to be performed. When this bit is "0", the dot-position shifting is not performed; while this bit is "1", the dot-position shifting is performed. The following two bits are bits indicating the size of a corresponding dot. When the two bits are "00", any dot is not formed, and when the two bits are "01", a small-size dot is formed. Further, when the two bits are "10", a middle-size dot is formed, and when the two bits are "11", a large-size dot is formed.

Figure 19:
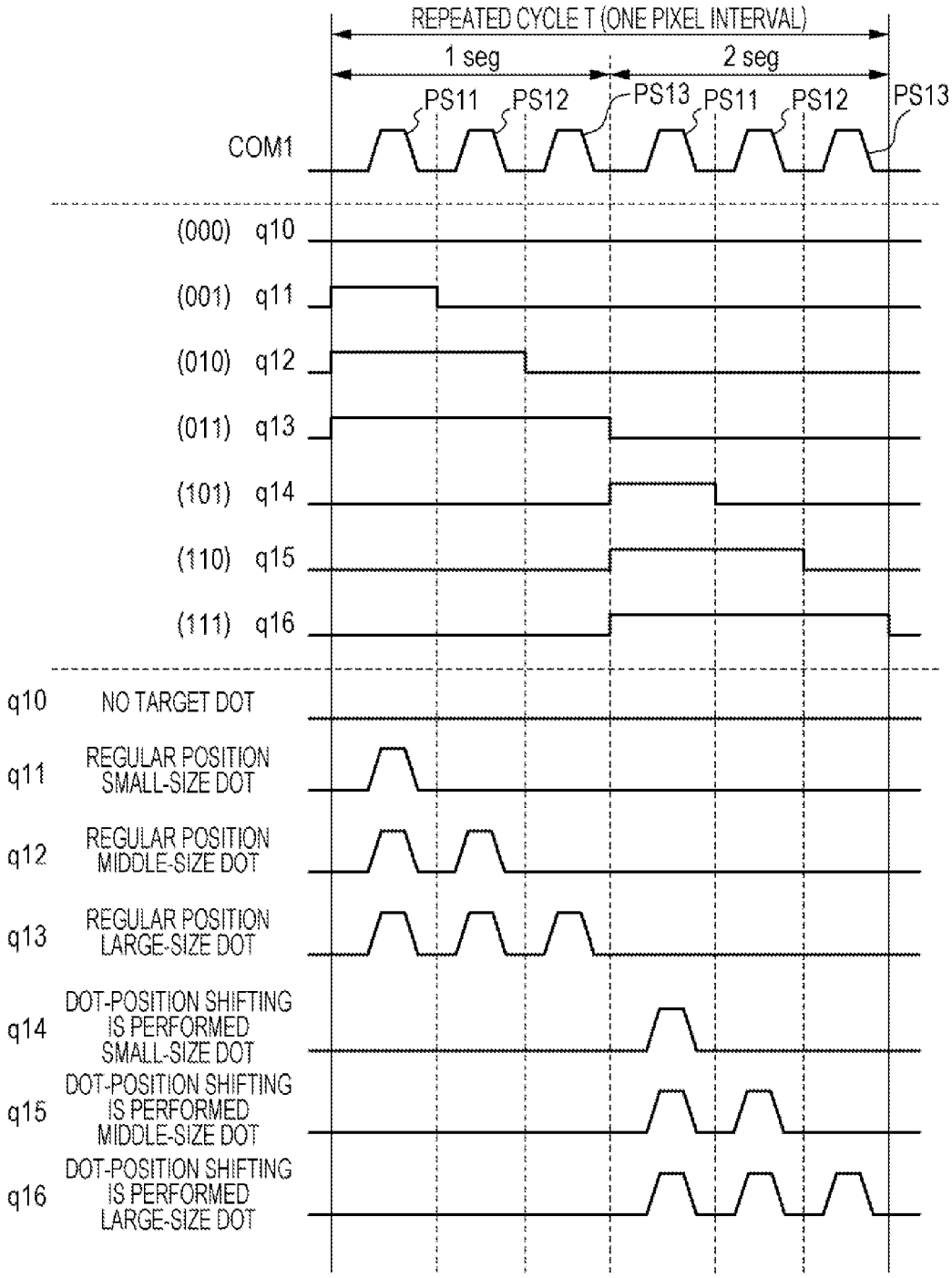
FIG. 19 is a diagram for describing a driving pulse in a color-ink ejection, according to a first embodiment of the invention.

FIG. 19 is a diagram for describing driving pulses for ejection of each of the color inks. In FIG. 19, the first driving signal COM1 and selection signals q10 to g16 corresponding to the pixel data SI are illustrated. Further, driving waveforms when the respective selection signals are selected are illustrated.

For example, when the pixel data SI is "010", a corresponding selection signal becomes the selection signal q12. In this case, since the highest-level bit is "0", the 1seg is selected. Further, as the result of the selection of the first driving pulse PS11 during a first period of the 1seg and the second driving pulse PS12 during a second period of the 1seg, a middle-size dot is formed.

Further, for example, when the pixel data SI is "101", a corresponding selection signal becomes the selection signal q14. In this case, since the highest-level bit is "1", the 2seg is selected. Further, as the result of the selection of only the first driving pulse PS11 during the first period of the 2seg, a small-size dot is formed. In addition, since the 2seg is a period posterior to the 1seg, a dot formed by at least one of the driving pulses of the 2seg is shifted to a position at an upper stream side than a position of a dot formed by at least one of the driving pulses of the 1seg in the transportation direction. Accordingly, through the selection of the 1seg or the 2seg, it is possible to perform fine adjustment of the dot formation position.

FIG. 20 is a diagram for describing the pixel data SI for the clear ink. The pixel data SI for the clear ink is also represented by three bits. The highest-level bit indicates whether or not a nozzle inspection is to be performed. When this bit is "0", a nozzle inspection for a corresponding nozzle is not performed, and when this bit is "1", a nozzle inspection for a corresponding nozzle is performed. The following two bits are bits indicating the size of a dot using the clear ink. When the two bits are "00", any dot using the clear ink is not formed, and when the two bits are "01", a small-size dot is formed. Further, when the two bits are "10", a middle-size dot is formed, and when the two bits are "11", a large-size dot is formed.

Figure 21:
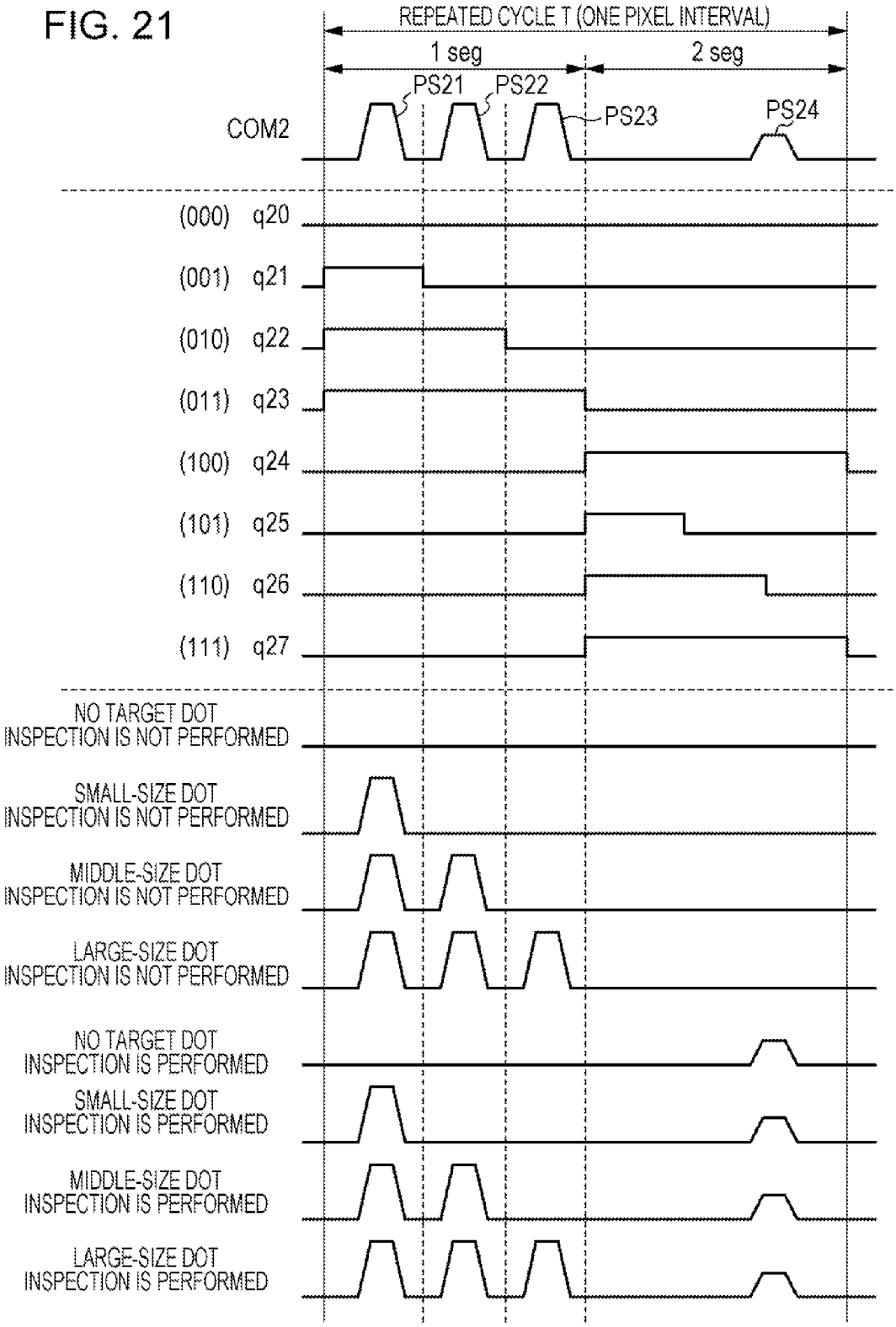
FIG. 21 is a diagram for describing a driving pulse in a clear-ink ejection, according to a first embodiment of the invention.

FIG. 21 is a diagram for describing driving pulses for ejection of the clear ink. In FIG. 21, the second driving signal COM2 and selection signals q21 to g27 corresponding to the pixel data SI for the clear ink are illustrated. Further, applied signals when the respective selection signals are selected are illustrated.

For example, when the pixel data SI for the clear ink is "010", a selection signal becomes the selection signal q22. In this case, since the highest-level bit is "0", a nozzle inspection for a corresponding a nozzle is not performed. Thus, the driving pulse PS24 is not outputted. Further, as the result of the selection of the first driving pulse PS21 during a first period of the 1seg and the second driving pulse PS22 during a second period of the 1seg, a middle-size dot is formed.

Further, for example, when the pixel data SI for the clear ink is "101", a selection signal becomes the selection signal q25. In this case, since the highest-level bit is "1", a nozzle inspection for a corresponding nozzle is performed. Thus, the driving pulse PS24 is outputted. Further, as the result of the selection of the first driving pulse PS21 during the first period of the 1seg, a small-size dot is formed. That is, as a result, a corresponding ejection unit forms a small-size dot, and subsequently, the driving pulse PS24 for a nozzle inspection is applied to the piezoelectric actuator 422 corresponding to the ejection unit, and the above-described nozzle inspection is performed. In addition, the residual vibration detection circuit 55 is used in common with rows of nozzles for the clear ink, and thus, it is only one nozzle that can be subjected to the nozzle inspection during one repeated cycle T. Thus, a nozzle corresponding to the highest-level bit having a value of "1" during one repeated period T is only one nozzle targeted for an ejection failure inspection among the nozzles 424s which are provided with the residual vibration detection circuit 55 in common. In this embodiment, the nozzle inspection is performed on a nozzle-by-nozzle basis, and thus, a nozzle corresponding to the highest-level bit having a value of "1" during one repeated period T is only one nozzle of the nozzles 424s for the clear ink.

In this way, even under the situation where it is difficult to halt printing in a printer provided with a continuous paper feeding mechanism, such as the printer 1 according to this embodiment, it is possible to perform printing concurrently with performing an ejection failure inspection for the clear ink. Moreover, in the color printing, it is also possible to perform the dot-position shifting, and thus, it is possible to improve a printing quality by appropriately performing this dot-position shifting.

In the above-described embodiment, the residual vibration is detected by using the piezoelectric actuator 422, but a dedicated sensor for detecting the residual vibration may be provided without depending on the piezoelectric actuator 422.

Figure 22:
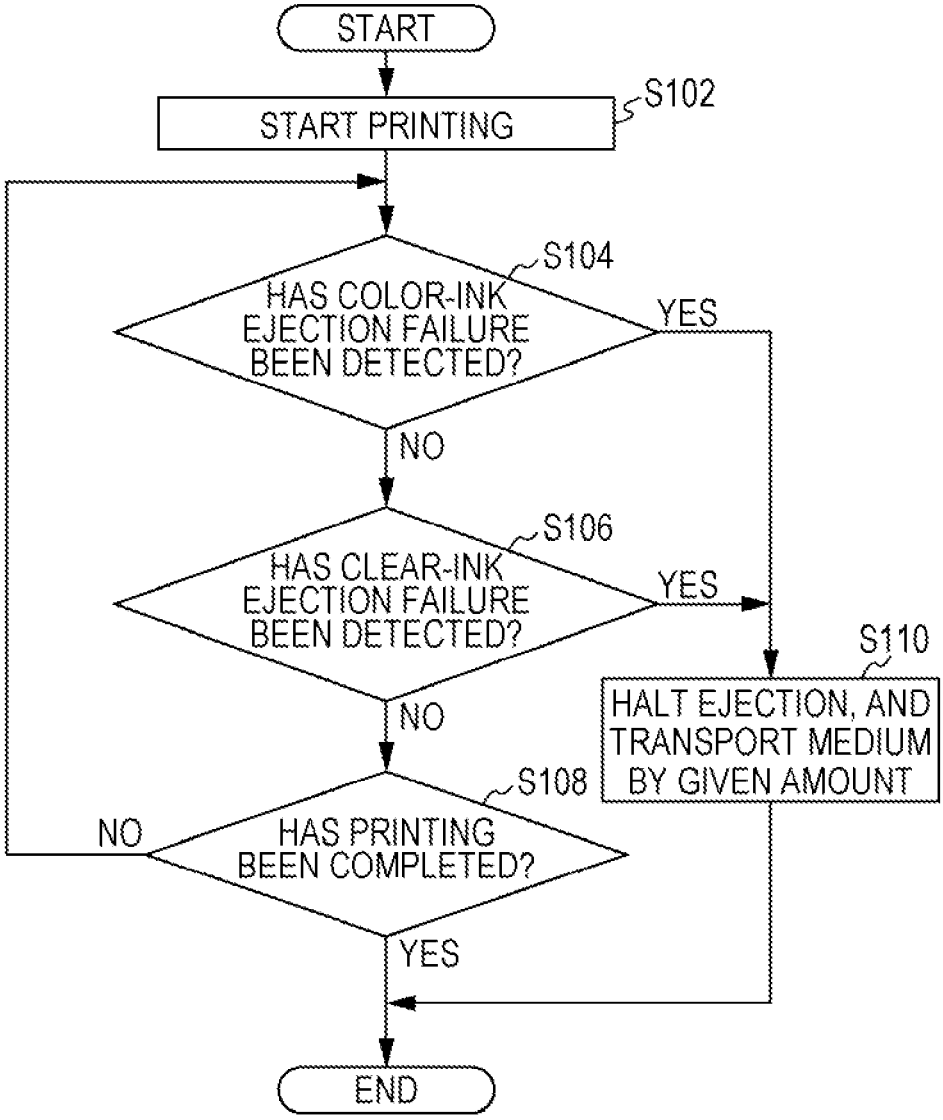
FIG. 22 is a flowchart of printing processing according to a first embodiment of the invention.
Figure 23:
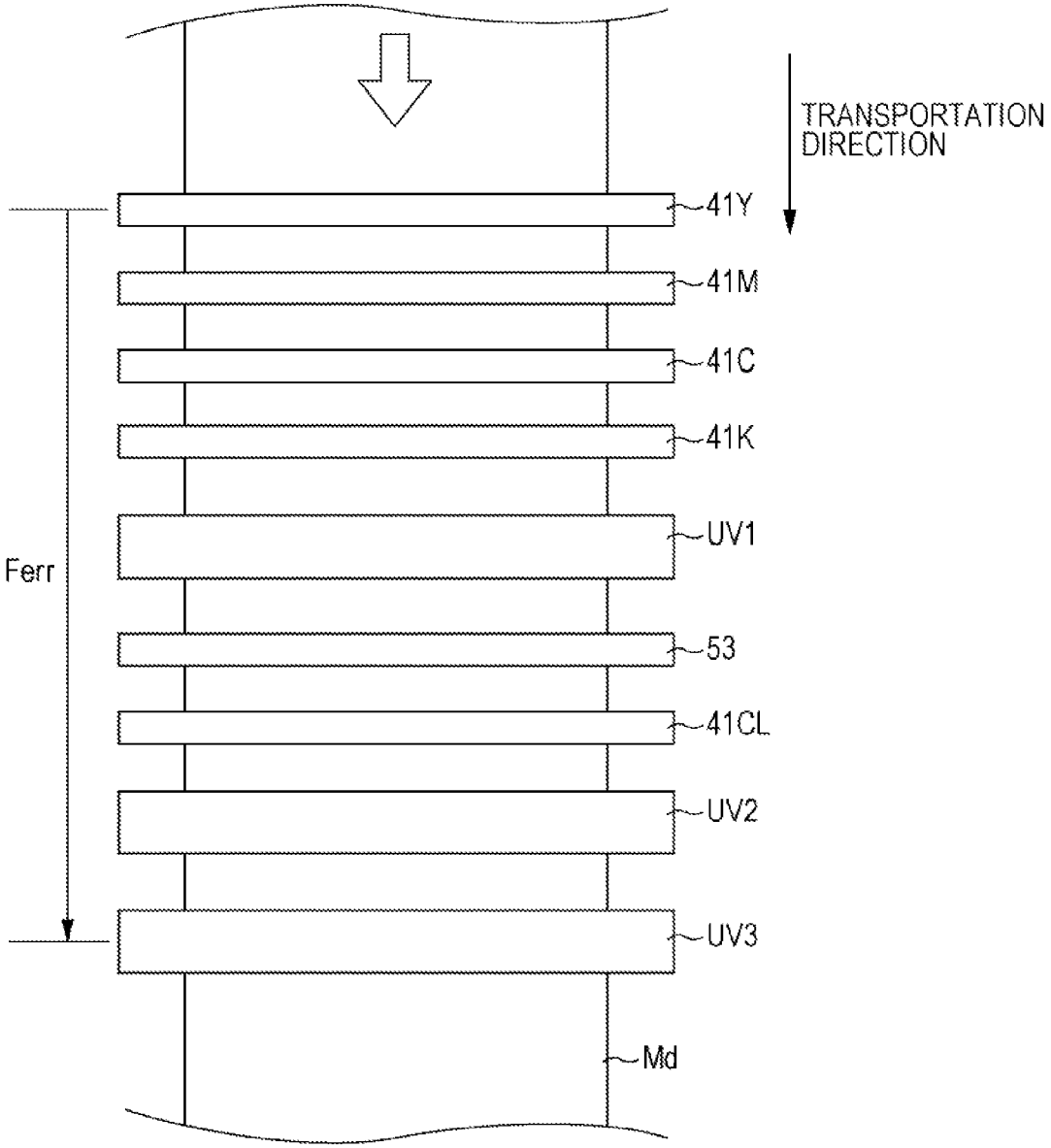
FIG. 23 is a diagram for describing a transportation amount after a halt of ejections, according to a first embodiment of the invention.

FIG. 22 is a flowchart illustrating printing processing according to this first embodiment. FIG. 23 is a diagram for describing a transportation amount after the halt of ejections. Hereinafter, printing processing according to this first embodiment will be described with reference to these figures.

First, the medium Md is set on the printer 1, and printing is started (S102). Concurrently with starting of the printing, the medium Md is transported in a transportation direction, and the color inks and the clear ink are ejected onto the medium.

Further, the irradiations of the ultraviolet rays from the first ultraviolet irradiation unit UV1 to the third ultraviolet irradiation unit UV3 are also started.

Next, the detection of a color-ink ejection failure is performed (S104). As described above, the detection of the color-ink ejection failure is performed by comparing an image having been detected by the image sensor unit 53 with an image to be formed on the medium Md on a pixel-by-pixel basis. Further, if any color-ink ejection failure is detected, processing in step S110 is performed.

Moreover, the detection of a clear-ink ejection failure is performed (S106). The detection of the clear-ink ejection failure is performed by the residual vibration detection circuit 55. Further, if any clear-ink ejection failure is detected, similarly, processing in step S110 is performed.

As described above, in the case where at least one of the color-ink ejection failure and the clear-ink ejection failure, the ejections of both the set of the color inks and the clear ink are halted (S110). At this time, the irradiations of ultraviolet rays from the ultraviolet irradiation units are not yet halted. Further, the medium is transported by a given transportation amount. In FIG. 23, a transportation amount Ferr by which the medium is transported at this time is illustrated. In this way, immediately after the detection of at least one of the color-ink ejection failure and the clear-ink ejection failure, by allowing the medium to be transported by at least the transportation amount Ferr starting from the yellow ink head unit 41Y located at the most upstream side, and terminating at the third ultraviolet irradiation unit UV3, it is possible to harden ink droplets having been landed on the medium Md. Further, when the medium Md is wound by the winding drum 23, it is also possible to prevent the medium from sticking to the medium itself because of ink droplets which are not yet hardened.

In addition, although, here, the medium is allowed to be transported by the transportation amount Ferr shown in FIG. 23, the medium may be allowed to be transported by a transportation amount starting from a head unit located at the most upstream side, and terminating at the first ultraviolet irradiation unit UV1.

Subsequently, when the halt of the ejections and the transportation of the medium have been completed, the printing processing is halted. Meanwhile, in the case where there is no failure in the ejections of the color inks and the ejection of the clear ink, it is determined whether or not all the printing have been completed. Further, if all the printing have been completed, the printing processing is terminated, and when all the printing have not yet been completed, the process flow returns to step S104 (S108).

Second Embodiment

Figure 24:
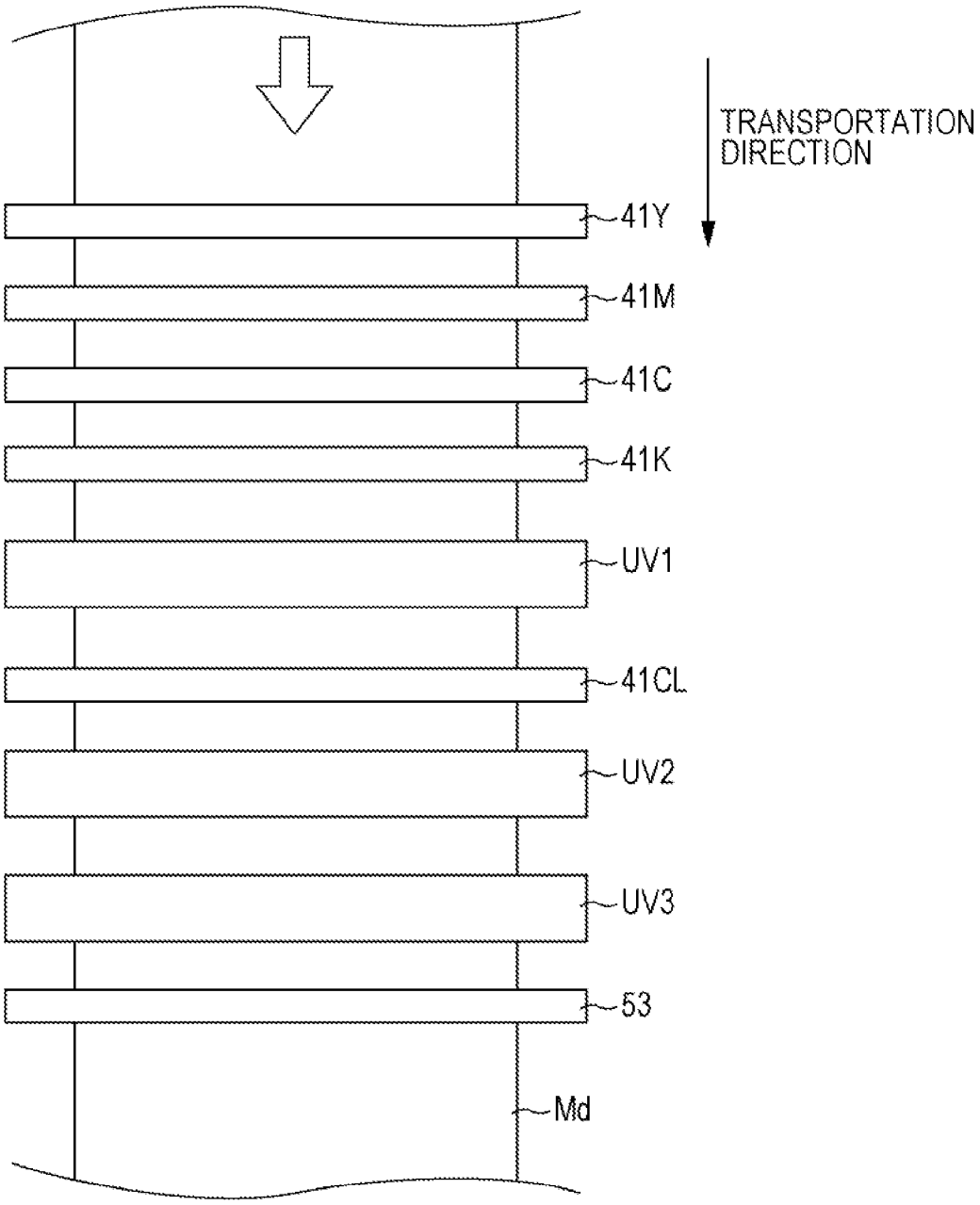
FIG. 24 is a top view when a printer is unfolded along a medium transportation path, according to a second embodiment of the invention.

FIG. 24 is a top view when a printer 1 according to a second embodiment is unfolded along a medium transporting path. The second embodiment is different from the first embodiment in the respect that the image sensor unit 53 is provided at the most downstream side in the transportation direction. This configuration causes the image sensor unit 53 to detect color images having been subjected to ejections of the color inks and the clear ink.

In such a case, as a result, the image sensor 53 detects a printed object which is obtained by causing color ink droplets to be landed onto a medium, and further, causing clear ink droplets to be landed onto the color ink droplets. Therefore, if the ejections of the clear ink are not appropriately performed, with respect to only raster lines on which the clear ink has not been appropriately ejected, there occurs a difference in a light reflectance ratio. Thus, with respect to color images detected by the image sensor unit 53, color images included in areas belonging to the above raster lines are slightly different from color images included in areas belonging to other raster lines. Consequently, it is likely to be difficult to appropriately detect the color-ink ejection failure.

Accordingly, in the configuration of the printer 1 according to this second embodiment, with respect to an image having been detected by the image sensor unit 53, an image correction in view of such a reflectance ratio as described above is performed on raster lines corresponding to an ejection failure nozzle for the clear ink, and a color-ink ejection failure is detected on the basis of an image resulting from the image correction.

Figure 25:
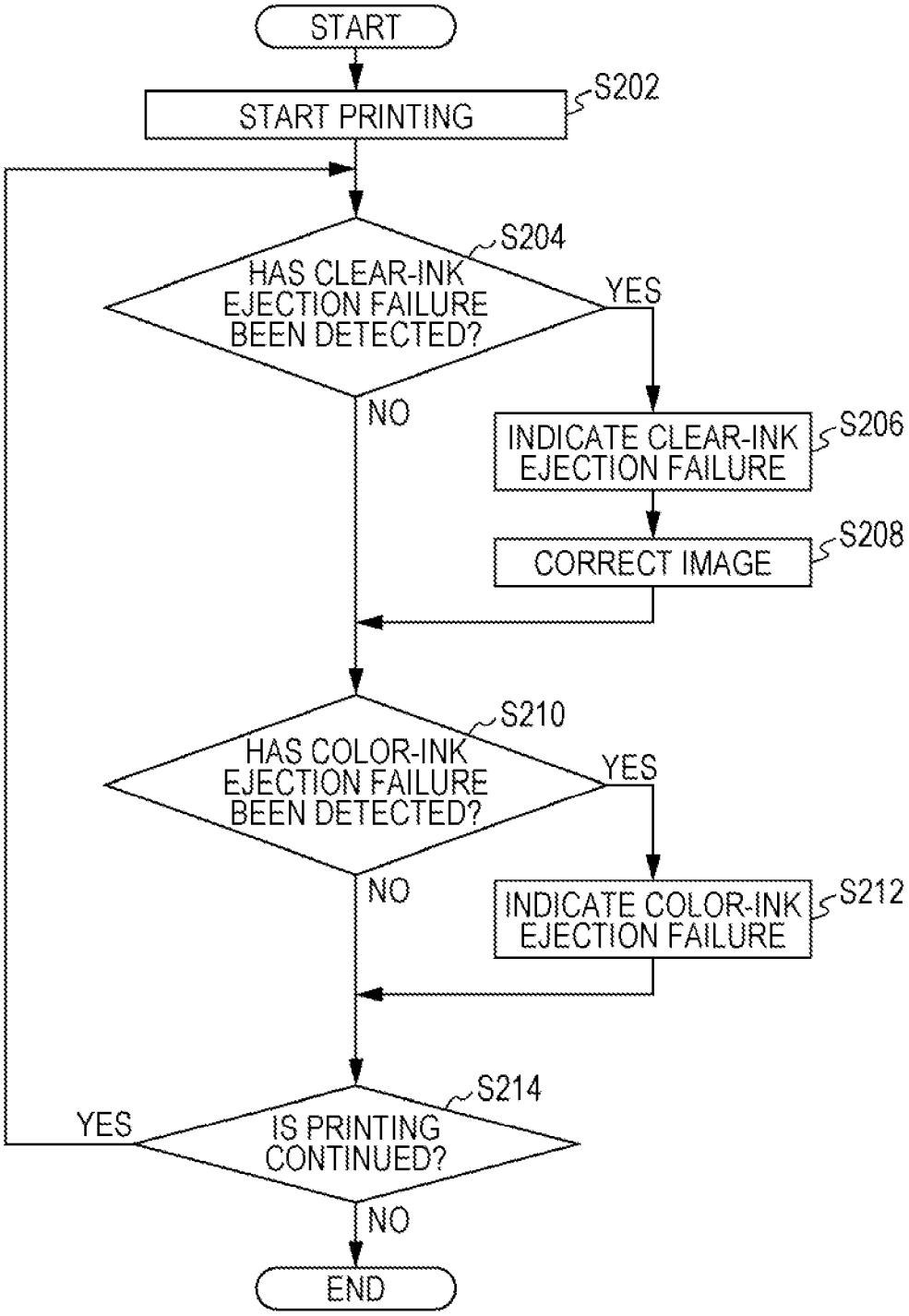
FIG. 25 is a flowchart of printing processing according to a second embodiment of the invention.

FIG. 25 is a flowchart illustrating printing processing according to a second embodiment. Hereinafter, printing processing according to this second embodiment will be described referring to this flowchart.

In this second embodiment, similarly, first, the medium Md is set on the printer 1, and printing is started (S202). Concurrently with starting of the printing, the medium Md is transported in the transportation direction, and the color inks and the clear ink are ejected onto the medium.

Next, the detection of a clear-ink ejection failure is performed (S204). Further, if any clear-ink ejection failure is detected, it is indicated on a display unit of the printer 1 or on the computer 110 that an ejection failure occurs in the clear ink (S206). Further, for an image having been formed by head units for the color inks, an image correction on portions corresponding to raster lines to be formed by an ejection failure nozzle is performed (S208).

Further, the detection of a color-ink ejection failure is performed on the basis of an image having been subjected to the image correction (on the basis of an image which is not subjected to the image correction in the case where a clear-ink ejection failure is not detected) (S210). Further, if any color-ink ejection failure is detected, the color-ink ejection failure is indicated on the display unit of the printer 1 or on the computer 110 (S212).

Further, it is determined whether or not this printing is to be continued (S214). In the case where a certain ejection failure occurs, since this ejection failure is indicated, a user can notify a command for halting printing to the printer 1 (No in step S214). Further, even in the case where a certain ejection failure occurs, if an influence on a printing quality is deemed to be small, the user can continue the printing (Yes in step S214).

In this way, in the case where the printer 1 is configured in such a way as shown in FIG. 24, it is possible to, in view of a clear-ink ejection failure, detect a color-ink ejection failure by using the image sensor unit 53. Moreover, in the case where any clear-ink ejection failure is detected, it is possible to determine whether recovery operation for recovering the ejection failure is to be performed only on the clear ink head unit 41CL, or the recovery operation is to be performed on not only the clear ink head unit 41CL but also a relevant color ink head unit.

In addition, in the configuration shown in FIG. 24, printing processing may be performed by employing the following method. That is, the clear-ink ejection failure may be detected by using both the residual vibration circuit 55 and the image sensor unit 53. In the case where this method is employed, when a clear-ink ejection failure has been detected, this clear-ink ejection failure can be ascertained by confirming that a corresponding failure has been also detected on raster lines, for which an ejection failure has been detected, on an image acquired by the image sensor unit 53. That is, in the case where both the residual vibration detection circuit 55 and the image sensor unit 53 have detected the same clear-ink ejection failure, it is possible to ascertain the clear-ink ejection failure.

In the above-described embodiment, an inspection (an inspection for an ejection failure) on each of the nozzles for the clear ink is performed by using the residual vibration detection circuit 55, and an inspection for each of the nozzles for the color inks is performed by using the image sensor unit 53, but the invention is not limited to this configuration. For example, in the case where inspections are performed on two groups of nozzles for respective two kinds of inks (a first ink and a second ink) for which optical changes detected by the image sensor unit 53 are different from each other, the inspections may be performed such that, if the optical change in the second ink is larger than that in the first ink, the inspection on the group of nozzles for the first ink is performed by using the residual vibration detection circuit 55 and the inspection on the group of nozzles for the second ink is performed by using the image sensor unit 53. That is, an inspection on a group of nozzles for an ink for which an optical change is relatively small may be performed by using the residual vibration detection circuit 55, and an inspection on a group of nozzles for an ink for which an optical change is relatively large may be performed by using the image sensor unit 53.

Further, in the above-described embodiment, the detection of a vibration change includes not only the detection of the vibration change with respect to the vibration plate 421, but also the detection of factors each causing this kind of vibration change, such as those having been described in the calculation model for the residual vibration. For example, the detection of a pressure change inside the cavity 423 and the detection of an ink-viscosity change are also included in the detection of the vibration change. Further, in the above-described embodiment, the signal outputted from each of the piezoelectric actuators 422s is detected, but the invention is not limited to this configuration. For example, a pressure sensor may be provided as a component which is different from the piezoelectric actuator 422, and a vibration may be detected by inputting a signal from this pressure sensor to a detection circuit (corresponding to the residual vibration detection circuit 55).

Further, in the 2seg of the second driving signal COM2 for the clear ink, there may be included, not only the fourth driving pulse PS4, but also a driving pulse for ejecting ink droplets through the nozzle 424 by increasing and reducing the capacity inside the cavity 423, or a driving pulse for causing a meniscus in the nozzle 424 to vibrate without ejecting any ink droplet through the nozzle 424. In this case, the number of driving pulses included in the 1seg of the second driving signal COM2 may be more than that included in the 2seg of the second driving signal COM2. This is because the 2seg of the second driving signal COM2 needs to include an inspection period as a period for generating a waveform for the inspection, but the 1seg of the second driving signal COM2 does not need to include such a period. A method in which the number of the driving pulses included in the 1seg of the second driving signal COM2 is more than that included in the 2seg of the second driving signal COM2 is more advantageous from a viewpoint of an image quality, as compared with a method in which the number of the driving pulses of the 1seg of the second driving signal COM2 is less than that of the 2seg thereof, because the number of dots which are formed within the repeated cycle T can be increased.

In the above-described embodiment, any one of the 1seg and the 2seg is selectively used in the first driving signal COM1 for the color inks, and both the 1seg and the 2seg are used in the second driving signal COM2 for the clear ink, but the invention is not limited to this configuration. For example, both the 1seg and the 2seg are used in the first driving signal COM1 as well as in the second driving signal COM2. In such a case, it is also possible to perform a clear-ink ejection failure inspection during a formation of an image.

Further, in the 2seg of the second driving signal COM2 for the clear ink, the fourth driving pulse PS4 is a driving pulse which does not allow any ink to be ejected, but the invention is not limited to this configuration. A vibration occurring in the ejection unit may be detected by using a driving pule which allows the clear ink to be ejected.

Further, in the above-described embodiment, the printer 1 performs a so-called line scanning in which the medium Md is caused to be transported relative to the head unit 40, but may perform a so-called serial scanning in which the head unit 40 is caused to move relative to the medium Md.

Other Embodiments

In the above-described embodiment, the printer 1 is described as a printing apparatus, but the invention is not limited to this configuration. According to different aspects of the invention, it is also possible to realize liquid discharge apparatuses which eject or discharge fluids other than the inks (i.e., liquids, liquid objects in which particles of a functional material are dispersed, and fluid objects such as gel materials). For example, the same technologies as those of the above-described embodiment may be applied to various apparatuses adopting ink jet technologies, such as a color filter manufacturing apparatus, a printing apparatus, a fine processing apparatus, a semiconductor manufacturing apparatus, a surface treatment apparatus, a three-dimensional molding apparatus, a liquid vaporization apparatus, an organic EL manufacturing apparatus (particularly, a polymer molecule EL manufacturing apparatus), a display manufacturing apparatus, a film formation apparatus, and a DNA chip manufacturing apparatus. Further, methods for realizing these apparatuses and methods for manufacturing these apparatuses are also included in the scope of the application of the invention.

The above-described embodiments are intended to make it easy to understand the invention, but are not intended to limit the interpretation of the invention. The invention may be modified or improved without departing from the gist of the invention, and further, obviously, equivalents thereof are included in the invention.

Regarding Head

In the above-described embodiment, an ink is ejected by using piezoelectric elements. But, a method for ejecting a liquid is not limited to this method. Other methods, such as a method for generating bubbles inside each of nozzles by using heat, may be adopted.

The entire disclosure of Japanese Patent Application No. 2012-084607, filed Apr. 3, 2012, No. 2012-104696, filed May 1, 2012, and No. 2012-104697, filed May 1, 2012 are expressly incorporated by reference herein.

What is claimed is:

1. A liquid discharge apparatus comprising:

a head provided with a plurality of discharge units including a first discharge unit including a first nozzle for discharging a liquid, a first pressure chamber that is communicated with the first nozzle, and a first driving element that is provided so as to correspond to the first pressure chamber, and a second discharge unit including a second nozzle for discharging a liquid, a second pressure chamber that is communicated with the second nozzle, and a second driving element that is provided so as to correspond to the second pressure chamber, wherein the liquid discharge apparatus causes a liquid to be discharged through the first nozzle by applying a first driving signal to the first driving element, wherein the liquid discharge apparatus causes a liquid to be discharged through the second nozzle by applying a second driving signal to the second driving element, wherein the first driving signal is different from the second driving signal, wherein, with respect to the first nozzle, it is determined on the basis of an image, detected by a first sensor, which is formed by causing the liquid to be discharged through the first nozzle whether or not the first nozzle causes a liquid discharge failure, and wherein, with respect to the second nozzle, it is determined on the basis of a detection signal, detected by a second sensor, which is obtained by applying the second driving signal to the second driving element whether or not the second nozzle corresponding to the second driving element causes a liquid discharge failure.

2. The liquid discharge apparatus according to claim 1, wherein the liquid discharged from the first nozzle is a color ink, and the liquid discharged from the second nozzle is a clear ink.

3. The liquid discharge apparatus according to claim 1, wherein a liquid discharge failure is detected in at least one of the first nozzle and the second nozzle, a discharge through the first nozzle and a discharge through the second nozzles are halted.

4. A liquid discharging method for use in a liquid discharge apparatus that includes a head provided with a plurality of discharge units including a first discharge unit including a first nozzle for discharging a liquid, a first pressure chamber that is communicated with the first nozzle, and a first driving element that is provided so as to correspond to the first pressure chamber, and a second discharge unit including a second nozzle for discharging a liquid, a second pressure chamber that is communicated with the second nozzle, and a second driving element that is provided so as to correspond to the second pressure chamber, the liquid discharging method comprising:

causing a liquid to be discharged through the first nozzle by applying a driving signal to the first driving element corresponding to the first nozzle;

causing a liquid to be discharged through the first nozzle by applying a first driving signal to the first driving element corresponding to the first nozzle;

causing a liquid to be discharged through the second nozzle by applying a second driving signal to the second driving element corresponding to the second first nozzle, wherein the first driving signal is different from the second driving signal;

with respect to the first nozzle, determining on the basis of an image, detected by a first sensor, which is formed by causing the liquid to be discharged through the first nozzle whether or not the first nozzles causes a liquid discharge failure; and with respect to the second nozzle, determining on the basis of a detection signal, detected by a second sensor, which is obtained by applying the second driving signal to the second driving element whether or not the second nozzle corresponding to the second driving element causes a liquid discharge failure.

* * * * *